US005586544A

United States Patent [19]

Kitamura et al.

[11] Patent Number: 5,586,544

[45] Date of Patent: Dec. 24, 1996

[54] FUEL INJECTION AMOUNT CONTROL SYSTEM FOR INTERNAL COMBUSTION ENGINES AND INTAKE PASSAGE WALL TEMPERATURE-ESTIMATING DEVICE USED THEREIN

[75] Inventors: Toru Kitamura; Akira Katoh; Katsuhiro Kumagai; Sachito Fujimoto; Hiroshi Kitagawa; Shunichi Tsuzuki; Jun Takahashi; Masami Watanabe, all of Wako, Japan

[73] Assignee: Honda Giken Kogyo Kabushiki Kaisha, Tokyo, Japan

[21] Appl. No.: 351,210

[22] Filed: Nov. 30, 1994

[30] Foreign Application Priority Data

| | | | |
|---|---|---|---|
| Nov. 30, 1993 | [JP] | Japan | 5-325831 |
| Dec. 16, 1993 | [JP] | Japan | 5-343761 |
| Dec. 16, 1993 | [JP] | Japan | 5-343762 |

[51] Int. Cl.[6] ..... F02D 41/06; F02D 41/14; F02D 41/32

[52] U.S. Cl. ..... 123/684; 123/480; 123/491; 73/117.3

[58] Field of Search ..... 123/679–687, 123/689, 491, 480, 478; 73/117.3

[56] References Cited

U.S. PATENT DOCUMENTS

| | | | |
|---|---|---|---|
| 4,357,923 | 11/1982 | Hidig | 123/492 |
| 4,499,879 | 2/1985 | Stoltman et al. | 123/480 |
| 4,922,877 | 5/1990 | Nagaishi | 123/682 |
| 4,987,890 | 1/1991 | Nagaishi | 123/492 |
| 5,144,933 | 9/1992 | Nakaniwa | 123/675 |
| 5,353,773 | 10/1994 | Ogawa et al. | 123/681 |

FOREIGN PATENT DOCUMENTS

| | | |
|---|---|---|
| 0326065B1 | 1/1993 | European Pat. Off. . |
| 3901109A1 | 7/1989 | Germany . |
| 58-8238 | 1/1983 | Japan . |
| 60-50974 | 11/1985 | Japan . |
| 61-126337 | 6/1986 | Japan . |
| 1-305142 | 12/1989 | Japan . |
| 3-59255 | 9/1991 | Japan . |

OTHER PUBLICATIONS

Patent Abstracts of Japan, vol. 17, No. 99, (M1373), Feb. 26, 1993 & JP–A–4–292544.

*Primary Examiner*—Andrew M. Dolinar

*Attorney, Agent, or Firm*—Nikaido, Marmelstein, Murray & Oram LLP

[57] ABSTRACT

A fuel injection mount control system for an internal combustion engine includes an ECU which calculates a first amount of fuel directly drawn into each combustion chamber out of an amount of fuel injected into the intake passage via a corresponding fuel injection valve, a second amount of fuel carried off fuel adhering to the wall surface of the intake passage into the combustion chamber, and an amount of fuel to be injected into the intake passage, based on the first fuel amount and the second fuel amount, calculates an air-fuel ratio correction amount, based on an output form an air-fuel ratio sensor arranged in the exhaust system, and corrects the amount of fuel to be injected into the intake passage by the air-fuel ratio correction amount. Further, the ECU corrects the second fuel amount, based on the air-fuel ratio correction amount.

32 Claims, 22 Drawing Sheets

FUEL INJECTION AMOUNT CONTROL SYSTEM FOR INTERNAL COMBUSTION ENGINES AND INTAKE PASSAGE WALL TEMPERATURE-ESTIMATING DEVICE USED THEREIN

BACKGROUND OF THE INVENTION

1. Field of the Invention

This invention relates to a fuel injection amount control system for controlling an amount of fuel injected into an intake passage of an internal combustion engine, and an intake passage wall temperature-estimating device for use with the control system, and more particularly to a fuel injection amount control system of this kind which is adapted to correct the fuel injection amount so as to compensate for delay in transfer of part of injected fuel to combustion chambers of the engine, and an intake passage wall temperature-estimating device for use with the control system.

2. Prior Art

While part of fuel injected via fuel injection valves into an intake pipe of an internal combustion engine directly flows into a combustion chamber of the engine, the remainder thereof once adheres to wall surfaces of the intake pipe including intake ports and then carried off the wall surfaces after a while to flow into the combustion chamber. A fuel injection amount control system is conventionally known, which estimates an amount of fuel to adhere to wall surfaces and an amount of fuel to be carried off the adherent fuel into the combustion chamber due to evaporation and other factors, and then determines an appropriate amount of fuel to be injected (fuel injection amount), by taking into account these estimated amounts of fuel, i.e. by effecting fuel transfer delay-dependent correction of the fuel injection amount.

The amount of fuel adhering to the wall surfaces of the intake pipe (hereinafter referred to as "the adherent fuel amount") is estimated based on a direct supply ratio A defined as the ratio of an amount of fuel directly drawn into a combustion chamber of a cylinder in one cycle of the cylinder to an amount of fuel injected for the cylinder in the same cycle, and a carry-off supply ratio B defined as the ratio of an amount of fuel carried off fuel adhering to the wall surfaces of the intake pipe into the combustion chamber of the cylinder through evaporation and other factors to an amount of the fuel adhering to the wall surfaces. An amount of fuel carried off the adherent fuel (hereinafter referred to as "the carried-off fuel amount") is estimated based on the carry-off supply ratio B and the adherent fuel amount.

More specifically, assuming that the adherent fuel amount is represented by Fw, the carried-off fuel amount by Fwout, and the fuel injection amount by Tout, a required fuel amount Tcyl, i.e. an amount of fuel required by the cylinder can be expressed by the following equation:

$$Tcyl=A\times Tout+Fwout$$

$$\text{where } Fwout=B\times Fw$$

Therefore, the fuel injection amount Tout can be expressed as follows:

$$Tout=(Tcyl-Fwout)\times(1/A)$$

However, such a fuel transfer delay-dependent correction is not sufficient for ensuring that the air-fuel ratio of a mixture supplied to the engine is properly controlled to a desired air-fuel ratio. For example, if fuel injection valves employed in the engine have operating characteristics other than proper ones, or a reference pressure set to a pressure regulator of a fuel pump of the engine deviates from a proper level, there arises an error in the actual fuel injection amount even if the fuel injection valve is driven by a pulse having an accurate pulse width. Similarly, variations in charging efficiency between individual engines (the charging efficiency determines an amount of fuel drawn into combustion chambers of the engine) can result in an unsuitable value of fuel injection amount which is set from a basic fuel injection amount map according to the engine rotational speed and pressure within the intake pipe, resulting in an error in the fuel injection amount Tout.

To eliminate such an error of the fuel injection amount ascribed to errors on the fuel injection valve side or manufacturing tolerances and/or aging of the engine, it has been conventionally proposed to carry out fuel transfer delay-dependent correction of the fuel injection amount by the use of an air-fuel ratio correction coefficient KO2 which is used in air-fuel ratio feedback control responsive to an output from an oxygen concentration sensor arranged in the exhaust system of the engine and which includes correction terms for correction of the above errors and tolerances, etc.

One of the proposed methods (first method) is disclosed by Japanese Provisional Patent Publication (Kokai) No. 58-8238 (corresponding to Japanese Patent Publication (Kokoku) No. 3-59255) in which the fuel injection amount Tout is obtained by multiplying the required injection amount Tcyl by the correction coefficient KO2 as expressed by the following equation:

$$Tout=(Tcyl\times KO2-Fwout)\times(1/A)$$

Another method (second method) is disclosed by Japanese Provisional Patent Publication (Kokai) No. 61-126337, in which a Tout value corrected for the adherent fuel is multiplied by the correction coefficient KO2 to obtain the fuel injection amount Tout by the use of the following equation:

$$Tout=[(Tcyl-Fwout)/A]\times KO2$$

According to the O2 feedback control using the correction coefficient KO2, the air-fuel ratio correction coefficient KO2 is calculated based on an output from an air-fuel ratio sensor (oxygen concentration sensor) arranged at a location upstream of a catalytic converter arranged in an exhaust passage of the engine, and the fuel injection amount Tout is determined based on the air-fuel ratio correction coefficient KO2.

However, the first and second methods suffer from the following problems:

(1) The correction of errors in the operating characteristics of fuel injection valves should be carried out such that the operating characteristics of the fuel injection valves alone are corrected without correcting a real or physical amount (g) of fuel injected thereby.

More specifically, let it be assumed that a fuel amount required by the engine is 10 g, and delivery of an injection pulse having a pulse width of 20 ms has been hitherto sufficient or suitable for injecting 10 g of fuel. If the fuel injection valve is replaced by one having a reduced nozzle bore, an injection pulse having a pulse width of 22 ms should be delivered to the fuel injection valve so as to adapt the operation of the fuel injection valve to the fuel amount required by the engine. In this case, although the injection pulse width is increased from 20 ms to 22 ms, the real or physical amount of fuel injected remains equal to 10 g.

Thus, in correcting the errors on the fuel injection valve side, it is not required to correct the real or physical amount (g) of fuel injected, but it suffices to correct only the width of an injection pulse supplied to the fuel injection valve. When the fuel injection valve is replaced by one having a reduced nozzle bore as in the above example, the value of the correction coefficient KO2 is increased accordingly, so that the injection pulse width is increased. However, the real or physical amount (g) of fuel flowing into the cylinder remains unchanged. Therefore, it is not required to increase the carried-off fuel amount Fwout (i.e. reduce the adherent fuel amount) as an amount of fuel carried off the fuel adherent to the wall surfaces of the intake pipe into the cylinder so as to follow up an increase in the KO2 value.

However, in the first method, anapparent or nominal amount of fuel (g) of Tcyl×KO2 is corrected as if this amount of fuel actually flowed into the cylinder, and hence if the fuel injection valve is replaced by one having a reduced nozzle bore as in the above example, the fuel injection amount Tout increased by the KO2 value (in the above example, by 10%) will be be reflected in the carried-off fuel amount Fwout after a certain time delay, resulting in an increase of 10% in the carried-off fuel amount. Thus, the correction of errors of operating characteristics of fuel injection valves by the first method causes the carried-off fuel amount Fwout to be unnecessarily changed following a change in the KO2 value, which prevents the fuel injection amount from being accurately corrected for fuel transfer delay.

In the second method as well, the fuel injection amount is apparently or nominally corrected such that an amount (g) of fuel multiplied by KO2 is injected, so that the carried-off fuel amount Fwout is changed in the same manner as in the first method, following the fuel injection amount Tout corrected by the KO2 value, which also prevents the fuel injection amount from being accurately corrected for fuel transfer delay.

(2) According to the air-fuel ratio control using the air-fuel ratio sensor (oxygen concentration sensor), the fuel injection amount Tout is increased or decreased by a change in the air-fuel ratio correction coefficient KO2 based on the output from the air-fuel ratio sensor. The air-fuel ratio correction coefficient KO2 is, therefore, a feedback control amount which increases and decreases cyclically with a varying repetition period. On the other hand, in the fuel transfer delay-dependent correction, the fuel injection amount Tout is corrected during a fuel transfer delay cycle, i.e. a change in the fuel injection amount→a change in the adherent fuel amount Fw→a change in the carried-off fuel amount Fwout. Thus, the carried-off fuel amount Fwout varies with a repetition period ascribed to this fuel transfer delay cycle. If the repetition period of change of the air-fuel ratio correction coefficient KO2 and the repetition period of change of the carried-off fuel amount Fwout become synchronous to each other, hunting of the KO2 value occurs, which prevents the fuel injection amount Tout from being properly determined.

For example, during a steady operating condition of the engine, e.g. when a vehicle with the engine installed therein is cruising, the intake pipe negative pressure and the engine rotational speed are nearly constant, so that the direct supply ratio A and the carry-off supply ratio B remain unchanged, with the required fuel amount Tcyl maintained constant. Even on such an occasion, according to the first and second methods, if the KO2 value is changed such that the air-fuel ratio of the mixture is converged to a desired air-fuel ratio, the fuel injection amount Tout is changed accordingly. The change in the fuel injection amount Tout is fed back to cause a change in the KO2 value with a time lag and hence changes in the fuel injection amount Tout and the carried-off fuel amount Fwout. Therefore, if the repetition period of change of the KO2 value and the period of change of the carried-off fuel amount Fwout become synchronous to each other, there occurs hunting of the KO2 value across the desired air-fuel ratio due to an excessive correction effected by the synchronous combination of the air-fuel ratio feedback control and the fuel transfer delay-dependent correction of the fuel injection amount.

As a result, the first and second methods conventionally proposed suffer from the problem of degraded drivability and degraded exhaust emission characteristics of the engine.

Further, conventional fuel injection amount control systems including ones employing the first and second methods do not contemplate the fact that part of fuel supplied into the combustion chamber is not burnt in the cylinder (unburnt fuel), and hence suffer from the following problems:

As already stated above, although part of fuel injected from the fuel injection valves flows directly into the cylinder, and the remainder thereof once adheres to wall surfaces of the intake port and then carried off into the cylinder, all the injected fuel is supplied to the cylinder after all. However, part of the fuel drawn into the cylinder forms unburnt fuel, such as non-atomized fuel (liquid granules) and adherent fuel adhering to inner wall surfaces of the cylinder, which is often generated when the engine is started in a cold condition, or after fuel cut after the engine has been shifted from a cranking mode to a normal mode.

Unless the fuel injection amount is corrected for the unburnt fuel component (HC), it can occur that the air-fuel ratio (A/F) within the cylinder is leaner than a required value which actually contributes to combustion, and consequently the engine suffers from unstable combustion when it is in an operating condition where the unburnt fuel component (HC) is generated in large amounts, such as at the start of the engine and immediately after the start of the engine.

Further, some of the conventional fuel injection amount control systems have proposed to effect the fuel transfer delay-dependent correction of the fuel injection amount by taking into account the wall temperature of the intake port, in view of the fact that the adherent fuel amount depends not only on the intake pipe negative pressure and the engine rotational speed but also on the intake port wall temperature. In this connection, to avoid an increased cost ascribed to an increased number of component parts, it has been proposed to estimate the intake port temperature by calculation without using a wall temperature sensor for directly detecting the intake port temperature, e.g. by Japanese Patent Publication (Kokoku) No. 60-50974 (third method) and Japanese Provisional Patent Publication (Kokai) No. 1-305142 (fourth method).

The third method calculates or estimates the intake port wall temperature based on the engine coolant temperature, a cumulative value of the engine rotational speed counted up from the start of the engine, etc. Then, a basic fuel injection amount is determined based on the engine rotational speed and the intake air amount, and the value of the basic fuel injection amount thus obtained is averaged to obtain an averaged function value. Thereafter, a value of the difference between the value of the basic fuel injection amount and the averaged function value is determined, and then a fuel correction amount is determined based on the determined difference and the intake port wall temperature estimated. The resulting correction fuel amount is added to the basic fuel injection amount to determine the fuel injection amount.

The fourth method determines an equilibrium wall temperature assumed when fuel adhering to the wall surfaces of the intake port is in an equilibrium state, and a delay time constant representing a delay time of change of the intake port wall temperature, based on the intake pipe negative pressure and the engine rotational speed, and the equilibrium wall temperature is corrected by the engine coolant temperature and the intake air temperature to set an instant wall temperature. The instant wall temperature is subjected to a first order delay processing by the use of the delay time constant to determine an estimated intake port wall temperature for correction of the fuel injection amount.

According to the third and fourth methods, however, the behavior or characteristic of the intake port wall temperature is not accurately grasped, and hence the intake wall port temperature cannot be accurately estimated under all operating conditions of the engine. As a result, there still remains the problem that the fuel transfer delay-dependent correction of fuel injection amount cannot be effected accurately, based on the intake port wall temperature estimated by the conventional methods.

SUMMARY OF THE INVENTION

It is a first object of the invention to provide a fuel injection amount control system for an internal combustion engine, which is capable of effecting fuel transfer delay-dependent correction of the fuel injection amount while preventing occurrence of hunting of the air-fuel ratio correction coefficient KO2 used in the fuel transfer delay-dependent correction of the fuel injection amount, to thereby prevent degradation of drivability and exhaust emission characteristics of the engine.

It is a second object of the invention to provide a fuel injection amount control system for an internal combustion engine, which is capable of effecting an accurate fuel transfer delay-dependent correction of the fuel injection amount so as to compensate for part of the injected fuel which remains unburnt in the cylinder, to thereby prevent degradation of drivability and exhaust emission characteristics of the engine.

It is a third object of the invention to provide an intake passage wall surface temperature-estimating device for an internal combustion engine, which is capable of accurately estimating the intake passage wall temperature under all operating conditions of the engine.

It is a fourth object of the invention to provide a fuel injection amount control system for an internal combustion engine, which is capable of effecting an accurate fuel transfer delay-dependent correction of the fuel injection amount, based on the intake passage wall temperature estimated by the intake passage wall surface temperature-estimating device of the invention.

In a first aspect of the invention, to attain the first object, there is provided a fuel injection amount control system for an internal combustion engine having an intake passage, the intake passage having a wall surface, at least one fuel injection valve, and at least one combustion chamber, including first fuel amount-calculating means for calculating a first amount of fuel directly drawn into the at least one combustion chamber out of an amount of fuel injected into the intake passage via the at least one fuel injection valve, second fuel amount-calculating means for calculating a second amount of fuel carried off fuel adhering to the wall surface of the intake passage into the at least one combustion chamber, fuel injection amount-calculating means for calculating an amount of fuel to be injected into the intake passage, based on the first amount of fuel and the second amount of fuel, air-fuel ratio-detecting means for detecting an air-fuel ratio of exhaust gases from the engine, air-fuel ratio correction amount-calculating means for calculating an air-fuel ratio correction amount, based on an output from the air-fuel ratio-detecting means, and air-fuel ratio correcting means for correcting the amount of fuel to be injected into the intake passage by the air-fuel ratio correction amount.

The fuel injection amount control system according to the invention is characterized by comprising carried-off fuel amount-correcting means for correcting the second fuel amount, based on the air-fuel ratio correction amount.

Prefereably, the carried-off fuel amount-correcting means includes carried-off fuel amount correction coefficient-setting means for setting a carried-off fuel amount correction coefficient such that the carried-off fuel amount correction coefficient assumes a smaller value as the air-fuel ratio correction amount is larger, the carried-off fuel amount-correcting means correcting the second amount of fuel by the carried-off fuel amount correction coefficient.

More preferably, the carried-off fuel amount correction coefficient is set such that the carried-off fuel amount correction coefficient is changed at a larger rate according to the air-fuel ratio correction amount, as a ratio of the first amount of fuel to the amount of fuel injected into the intake passage is smaller.

In a second aspect of the invention, to attain the second object, there is provided a fuel injection amount control system for an internal combustion engine having an intake passage, the intake passage having a wall surface, at least one fuel injection valve, at least one combustion chamber, and an exhaust passage, comprising:

first fuel amount-calculating means for calculating a first amount of fuel directly drawn into the at least one combustion chamber and burned therein out of an amount of fuel injected into the intake passage via the at least one fuel injection valve;

second fuel amount-calculating means for calculating a second amount of fuel directly drawn into the at least one combustion chamber and exhausted therefrom without being burned therein out of the amount of fuel injected into the intake passage via the at least one fuel injection valve;

third fuel amount-calculating means for calculating a third amount of fuel carried off fuel adhering to the wall surface of the intake passage into the at least one combustion chamber; and fuel injection amount-calculating means for calculating an amount of fuel to be injected into the intake passage, based on the first amount of fuel, the second amount of fuel and the third amount of fuel.

Preferably, the second amount of fuel is calculated based on the amount of fuel injected into the intake passage and an unburnt fuel ratio determined based on operating conditions of the engine.

More specifically, the operating conditions of the engine include a temperature of coolant circulating through the engine, the unburnt fuel ratio being set to a larger value as the engine coolant temperature is lower.

Also preferably, the unburnt fuel ratio is set to a large initial value immediately after the engine has started or resumed fuel injection.

To attain the second object of the invention, there is further provided a fuel injection amount control system for an internal combustion engine having an intake passage, the intake passage having a wall surface, at least one fuel injection valve, at least one combustion chamber, and an exhaust passage, comprising:

first fuel amount-calculating means for calculating a first amount of fuel directly drawn into the at least one combustion chamber out of an amount of fuel injected into the intake passage via the at least one fuel injection valve;

second fuel amount-calculating means for calculating a second amount of fuel carried off fuel adhering to the wall surface of the intake passage into the at least one combustion chamber and burned therein;

third fuel amount-calculating means for calculating a third amount of fuel carried off the fuel adhering to the wall surface of the intake passage into the at least one combustion chamber and exhausted therefrom without being burnt therein; and fuel injection amount-calculating means for calculating an amount of fuel to be injected into the intake passage, based on the first amount of fuel, the second amount of fuel and the third amount of fuel.

Also in this control system, preferably the second amount of fuel is calculated based on the amount of fuel injected into the intake passage and an unburnt fuel ratio determined based on operating conditions of the engine.

More specifically, the operating conditions of the engine include a temperature of coolant circulating through the engine, the unburnt fuel ratio being set to a larger value as the engine coolant temperature is lower, the unburnt fuel ratio being set to a large initial value immediately after the engine has started or resumed fuel injection.

In a third aspect of the invention, to attain the third object, there is provided an intake passage wall surface temperature-estimating device for an internal combustion engine having an intake passage, the intake passage having a wall surface, comprising:

coolant temperature-detecting means for detecting a temperature of coolant circulating through the engine;

intake air temperature-detecting means for detecting a temperature of intake air in the intake passage of the engine; and intake passage wall surface temperature-estimating means for estimating a temperature of the wall surface of the intake passage, based on the coolant temperature detected by coolant temperature-detecting means and the temperature of the intake air in the intake passage detected by the intake air temperature-detecting means, at an intermediate temperature between the coolant temperature and the temperature of the intake air.

Preferably, the intake passage wall surface temperature-estimating means interiorty divides a difference between the coolant temperature and the temperature of the intake air, by a predetermined interior division ratio, thereby estimating the intake passage wall surface temperature.

Also preferably, the intake passage wall surface temperature-estimating means estimates the intermediate temperature between the coolant temperature and the temperature of the intake air in the intake passage as a temperature of the wall surface of the intake passage in a steady condition of the engine, and further subjects the temperature of the wall surface of the intake passage in the steady condition of the engine to delay processing, thereby estimating a temperature of the wall surface of the intake passage in a transient condition of the engine.

Advantageously, the temperature of the intake air in the intake passage detected by the intake air temperature-detecting means is corrected by an amount of change in an output from the intake air temperature-detecting means.

Further preferably, the engine includes an exhaust passage, and exhaust gas-recirculating means for recirculating exhaust gases from the exhaust passage to the intake passage, and wherein the intake passage wall surface temperature-estimating means sets the predetermine interior division ratio depending on a ratio of exhaust gas recirculation effected by the exhaust gas-recirculating means.

In a fourth aspect of the invention, to attain the fourth object, there is provided a fuel injection amount control system for an internal combustion engine having an intake passage, comprising:

fuel injection amount-determining means for calculating parameters indicative of fuel transfer characteristics in the intake passage, based on operating conditions of the engine, and for determining an amount of fuel to be injected into the intake passage, depending on the parameters calculated;

coolant temperature-detecting means for detecting a temperature of coolant circulating through the engine;

intake air temperature-detecting means for detecting a temperature of intake air in the intake passage of the engine;

intake passage wall surface temperatureestimating means for estimating a temperature of the wall surface of the intake passage, based on the coolant temperature detected by coolant temperature-detecting means and the temperature of the intake air in the intake passage detected by the intake air temperature-detecting means, at an intermediate temperature between the coolant temperature and the temperature of the intake air; and parameter correcting means for correcting the parameters indicative of the fuel transfer characteristics in the intake passage, based on the temperature of the wall surface of the intake passage estimated by the intake passage wall surface temperature-estimating means.

The above and other objects, features and advantages of the invention will become more apparent from the following detailed description taken in conjunction with the accompanying drawings.

DETAILED DESCRIPTION

The invention will now be described in detail with reference to the drawings showing embodiments thereof.

Figure 1:
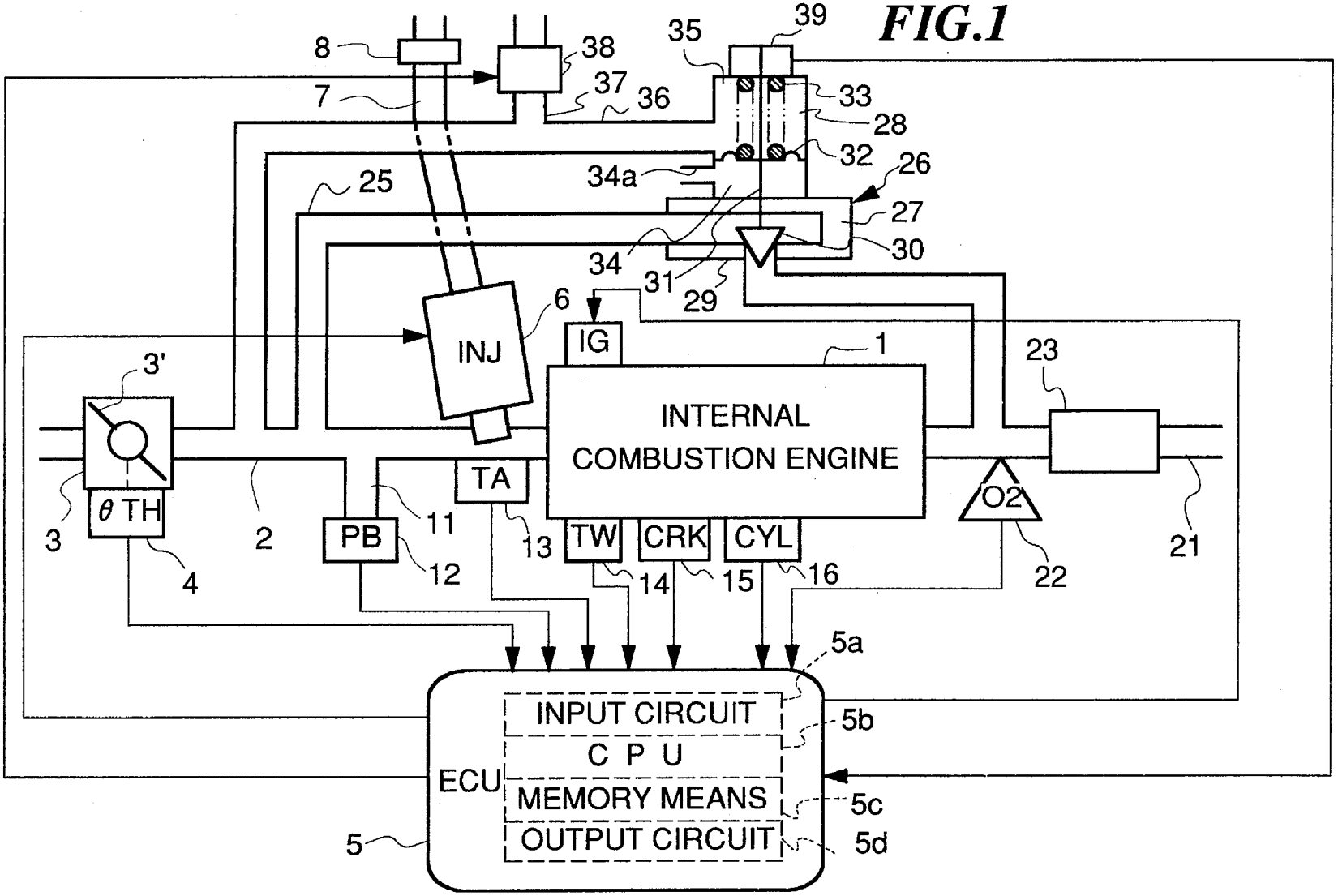
FIG. 1 is a block diagram showing the whole arrangement of a fuel injection amount control system for an internal combustion according to an embodiment of the invention.

Referring first to FIG. 1, there is illustrated the whole arrangement of a fuel injection amount control system for an internal combustion engine, which incorporates an intake passage wall surface temperature-estimating device, according to an embodiment of the invention.

In the figure, reference numeral 1 designates a straight type four-cylinder internal combustion engine (hereinafter simply referred to as "the engine"). Connected to intake ports 2A of the cylinder block of the engine 1 is an intake pipe 2 across which is arranged a throttle body 3 accommodating a throttle valve 3' therein. A throttle valve opening (θTH) sensor 4 is connected to the throttle valve 3', for generating an electric signal indicative of the sensed throttle valve opening and supplying same to an electric control unit (hereinafter referred to as "the ECU 5").

Fuel injection valves (injectors) 6, only one of which is shown, are inserted into the intake pipe 2 at locations intermediate between the cylinder block of the engine 1 and the throttle valve 3' and slightly upstream of respective intake valves, not shown. The fuel injection valves 6 are connected to a fuel pump 8 via a fuel supply pipe 7 and electrically connected to the ECU 5 to have their valve opening periods controlled by signals therefrom.

An intake pipe negative pressure (PB) sensor 12 is provided in communication with the interior of the intake pipe 2 via a conduit 11 opening into the intake pipe 2 at a location downstream of the throttle valve 3', for supplying an electric signal indicative of the sensed negative pressure within the intake pipe 2 to the ECU 5.

An intake air temperature (TA) sensor 13 is inserted into the intake pipe 2 at a location downstream of the conduit 11, for supplying an electric signal indicative of the sensed intake air temperature TA to the ECU 5.

An engine coolant temperature (TW) sensor 14 formed of a thermistor or the like is inserted into a coolant passage filled with a coolant and formed in the cylinder block, for supplying an electric signal indicative of the sensed engine coolant temperature TW to the ECU 5.

A crank angle (CRK) sensor 15 and a cylinder-discriminating (CYL) sensor 16 are arranged in facing relation to a camshaft or a crankshaft of the engine 1, neither of which is shown. The CRK sensor 15 generates a CRK signal pulse whenever the crankshaft rotates through a predetermined angle (e.g. 30 degrees) smaller than half a rotation (180 degrees) of the crankshaft of the engine 1. CRK signal pulses are supplied to the ECU 5, and a TDC signal pulse is generated based on the CRK signal pulses. That is, the TDC signal pulse is representative of a reference crank angle position of each cylinder, and is generated whenever the crankshaft rotates through 180 degrees.

Further, the ECU 5 calculates a CRME value by measuring time intervals between adjacent CRK signal pulses, and adds up CRME values over each time interval between two adjacent TDC signal pulses to obtain an ME value. Then, the engine rotational speed NE is calculated by calculating the reciprocal of the ME value.

The CYL sensor 16 generates a pulse (hereinafter referred to as "the CYL signal pulse") at a predetermined crank angle (e.g. 10 degrees before TDC) of a particular cylinder of the engine assumed before a TDC position corresponding to the start of intake stroke of the particular cylinder, and the CYL signal pulse being supplied to the ECU 5.

Further, the ECU 5 sets stages of each cycle of each cylinder. More specifically, the ECU 5 sets a #0 crank angle stage in correspondence to a CRK signal pulse detected immediately after generation of the TDC signal pulse. Then, the stage number is incremented by 1 whenever one CRK signal pulse is detected thereafter, thereby sequentially setting #0 stage to #5 stage for each cycle of each cylinder in the case of a four-cylinder engine which generates CRK signal pulses at intervals of 30 degrees.

Each cylinder of the engine has a spark plug 17 electrically connected to the ECU 5 to have its ignition timing controlled by a signal therefrom.

An O2 sensor 22 as an air-fuel ratio sensor is arranged in an exhaust pipe 21 for detecting the concentration of oxygen contained in exhaust gases and supplying an electric signal indicative of the sensed oxygen concentration to the ECU 5. A catalytic converter (three-way catalyst) 23 is arranged in the exhaust pipe 21 at a location downstream of the O2 sensor 22, for purifying noxious components, such as HC, CO, and NOx, which are present in exhaust gases.

Next, an exhaust gas recirculation (EGR) system will be described.

An exhaust gas recirculation passage 25 is arranged between the intake pipe 2 and the exhaust pipe 21 such that it bypasses the engine 1. The exhaust gas recirculation passage 25 has one end thereof connected to the exhaust pipe 21 at a location upstream of the O2 sensor 22 (i.e. on the engine side of same), and the other end thereof connected to the intake pipe 2 at a location upstream of the PB sensor 12.

An exhaust gas circulation control valve (hereinafter referred to as "the EGR control valve") 26 is arranged in the exhaust gas recirculation passage 25. The EGR valve 26 is comprised of a casing 29 defining a valve chamber 27 and a diaphragm chamber 28 therein, a valving element 30 in the form of a wedge arranged in the valve chamber 27, which is vertically movable so as to open and close the exhaust gas recirculation passage 25, a diaphragm 32 connected to the valving element 30 via a valve stem 31, and a spring 33 urging the diaphragm 32 in a valve-closing direction. The diaphragm chamber 28 is divided by the diaphragm 32 into an atmospheric pressure chamber 34 on the valve stem side and a negative pressure chamber 35 on the spring side.

The atmospheric pressure chamber 34 is communicated with the atmosphere via an air inlet port 34*a*, while the negative pressure chamber 35 is connected to one end of a negative pressure-introducing passage 36. The negative pressure-introducing passage 36 has the other end thereof connected to the intake pipe 2 at a location between throttle valve body 3 and the other end of the exhaust gas recirculation passage 25, for introducing the negative pressure PB into the negative pressure chamber 35. The negative pressure-introducing passage 36 has an air-introducing passage 37 connected thereto, and the air-introducing passage 37 has a pressure control valve 38 arranged therein. The pressure control valve 38 is an electromagnetic valve of a normally-closed type, and negative pressure prevailing within the negative pressure-introducing passage 38 is controlled by the pressure control valve 38, whereby a predetermined level of negative pressure is created within the negative pressure chamber 35.

A valve opening (lift) sensor 39 is provided for the EGR valve 26, which detects an operating position (lift amount) of the valving element 30 thereof, and supplies a signal indicative of the sensed lift amount to the ECU 5. In addition, the EGR control is carried out after the engine has been warmed up (e.g. when the engine coolant temperature TW exceeds a predetermined value).

The ECU 5 is comprised of an input circuit 5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as the "the CPU") 5*b*, memory means 5*c* storing various operational programs which are executed by the CPU 5*b*, and various maps and tables, referred to hereinafter, and for storing results of calculations therefrom, etc., and an output circuit 5*d* which outputs driving signals to the fuel injection valves 6, the fuel pump 8, the spark plugs 17, etc. respectively.

Further, the ECU 5 estimates the temperature (hereinafter referred to as "port wall temperature") of the walls of the intake ports 2A where the injected fuel can adhere in part, and sets various operating parameters based on the estimated port wall temperature, to thereby effect fuel transfer delay-dependent correction of the fuel injection amount. Further, the ECU 5 determines various operating regions of the engine, such as an air-fuel ratio feedback control region where the air-fuel ratio feedback control is carried out in response to the concentration of oxygen in exhaust gases detected by the O2 sensor 22, and open-loop control regions.

Although in the present embodiment, the intake air temperature sensor 13 is inserted through the wall of the intake pipe 2 at a location downstream of the throttle valve 3', this is not limitative, but it may be arranged upstream of the throttle valve 3'. However, the value of a middle point-setting coefficient X0, referred to hereinafter, needs to be set depending on where the intake air temperature sensor 13 is arranged.

Now, how the fuel transfer delay-dependent correction of the fuel injection amount is carried out during the fuel injection amount control according to the present embodiment will be described.

Before describing details of the fuel transfer delay-dependent correction of the fuel injection amount, the principle of the fuel transfer delay-dependent correction will be described with reference to FIG. 2 to FIG. 8.

Figure 2:
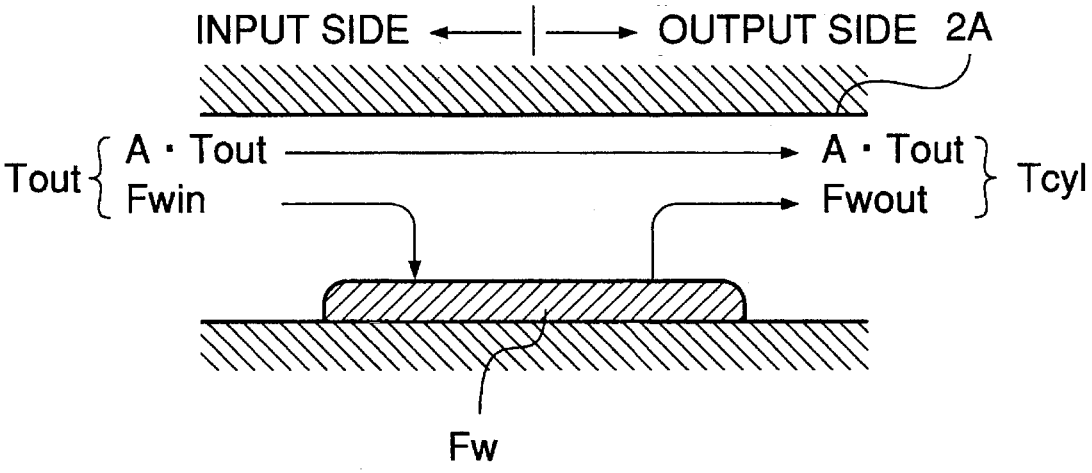
FIG. 2 is a conceptual representation of the relationship between a fuel injection amount Tout and a required fuel amount Tcyl.

FIG. 2 conceptually represents the relationship between a fuel injection amount Tout and a required fuel amount Tcyl.

The fuel injection amount Tout appearing in the figure represents an amount of fuel injected via the fuel injection valve 6 into the intake pipe 2, in one cycle of the cylinder. Out of the fuel injection amount Tout, an amount (A×Tout) of a portion thereof is directly drawn into the cylinder without adhering to the wall surface of the intake port 2A, while the remainder of the fuel injection amount Tout is added as an adherent fuel increment Fwin to the adherent fuel amount Fw of fuel having adhered to the wall surface of the intake port 2A up to the immediately preceding cycle of the cylinder, i.e. before the present injection. Here, the symbol A represents a direct supply ratio defined as the ratio of an amount of fuel directly drawn into the combustion chamber of the cylinder in one cycle of the cylinder to an amount of fuel injected for the cylinder in the same cycle of the cylinder, which assumes a value in the range of $0<A<1$.

The sum of the amount (A×Tout) of fuel and a carried-off fuel amount Fwout of fuel carried off the wall surfaces, i.e. away from the adherent fuel amount Fw forms the required fuel amount Tcyl actually supplied to the cylinder.

Next, a first method of the fuel transfer delay-dependent correction of the fuel injection amount according to the invention will be described.

The first method is based on the concept that a change in the carried-off fuel amount Fwout follows up a change in the adherent fuel increment Fwin with a predetermined time delay. This relationship between the adherent fuel increment Fwin and the carried-off fuel amount Fwout is expressed e.g, by an equation of a first-order delay model in which the degree of delay of the carried-off fuel amount relative to the adherent fuel increment Fwin is represented by a delay-setting coefficient (delay time constant) T.

As described hereinabove, the required fuel amount Tcyl is determined by Equation (1):

$$Tcyl=A\times Tout+Fwout \quad (1)$$

Therefore, the fuel injection amount Tout can be determined by Equation (2):

$$Tout=(Tcyl-Fwout)\times(1/A) \quad (2)$$

Further, the adherent fuel increment Fwin can be determined by Equation (3):

$$Fwin=(1-A)\times Tout \quad (3)$$

Since the carried-off fuel amount Fwout is a function of the adherent fuel increment Fwin with the first-order delay, it can be expressed in a discrete representation by Equation (4):

$$Fwout(n)=Fwout(n-1)+(1/T)\times(Fwin-Fwout) \quad (4)$$

where T represents the aforementioned delay time constant which is set to a value corresponding to a time period required to elapse from the time the carried-off fuel amount Fwout starts to change with a change in the adherent fuel increment to the time the change amount reaches 63.2% of the whole change in the carried-off fuel amount Fwout. This value T is set depending on operating conditions of the engine.

According to Equation (4), the carried-off fuel amount Fwout(n) calculated for the present injection is increased relative to the immediately-preceding value thereof by an amount of the product of a value (1/T) and a value (difference) obtained by subtracting the carried-off fuel amount Fwout from the adherent fuel increment Fwin. The same calculation is carried out for each cycle, whereby the carried-off fuel amount Fwout becomes closer to the adherent fuel increment Fwin by an increment of 1/T of the above difference between Fwout and Fwin.

Figure 3:
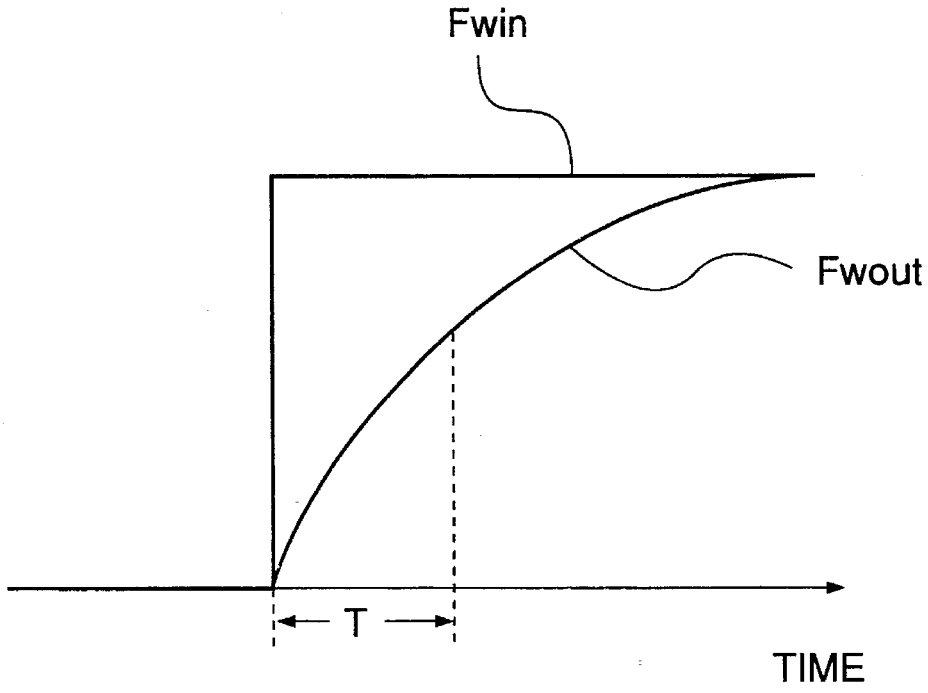
FIG. 3 is a diagram which is useful in explaining a delay time constant T.

For example, if the fuel injection amount Tout is stepwise increased, the adherent fuel increment Fwin stepwise increases as shown in FIG. 3, provided that the direct supply ratio A is constant. In contrast, the carried-off fuel amount Fwout progressively or slowly becomes closer to the adherent fuel increment Fwin at a rate corresponding to the time constant T, in response to the increase in the adherent fuel increment Fwin.

Then, the fuel injection amount Tout is determined by the use of Equations (2), (3), and (4) described above.

Figure 4:
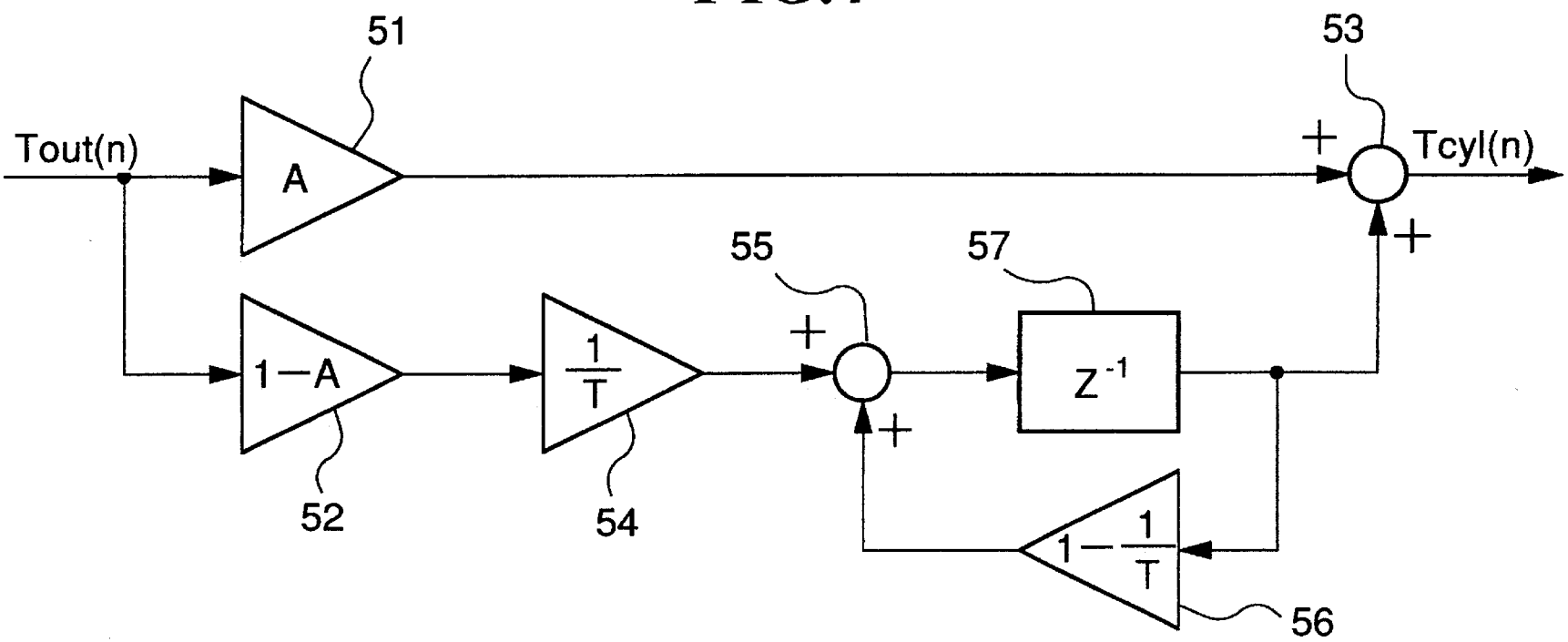
FIG. 4 is a schematic representation of a physical model circuit modeled on fuel transfer delay-dependent correction of the fuel injection amount according to an AT method.

FIG. 4 schematically represents a physical model circuit modeled on fuel transfer delay-dependent correction of the fuel injection amount according to the first method described above (hereinafter referred to as the AT method).

In the figure, the fuel injection amount Tout(n) injected via the fuel injection valve 6 in the present cycle (n) is multiplied by the direct supply ratio A at a multiplier 51, while it is also multiplied by (1−A) at a multiplier 52. The multiplier 51 delivers an output of (A×Tout(n)) to an adder 53, where the value (A×Tout(n)) is added to a carried-off fuel amount Fwout(n) calculated for the present injection, to thereby determine the required fuel amount Tcyl for the present injection.

On the other hand, the multiplier 52 delivers an output of the attached fuel increment Fwin(n) determined by Equation (3) described above, i.e. Fwin(n)=(1−A)×Tout(n). This value is further multiplied by (1/T) at a multiplier 54 and then supplied to an adder 55, where the resulting product of (1/T)×Fwin(n) is added to an output from a multiplier 56. The multiplier 56 delivers a value of the product of the carried-off fuel amount Fwout(n) for the present injection and (1−1/T), i.e. (1−1/T)×Fwout(n).

Further, since the carried-off fuel amount Fwout(n) is an output from a cycle delay block 57 which delays an input thereto by one cycle, an input to the cycle delay block 57 should be a value Fwout(n+1) of the carried-off fuel amount for the following injection.

Therefore, an output from the adder 55, i.e. the carried-off fuel amount Fwout(n+l) input to the cycle delay block 57 is calculated by Equation (5):

$$Fwout(n+1)=Fwin(n)/T+(1-1/T)\times Fwout(n)=Fwout(n)+1/T\times(Fwin(n)-Fwout(n)) \quad (5)$$

provided that Fwin(n)=(1−A)×Tout(n).

As can be clearly seen from the above, Equation (5) corresponds to Equation (4) stated above.

Next, the second method of the fuel transfer delay-dependent correction of the fuel injection amount will be described.

The second method is disclosed e.g. in Japanese Provisional Patent Publication (Kokai) No. 58-8238 (corresponding to Japanese Patent Publication (Kokoku) No. 3-59255), referred to hereinbefore. According to the method, in addition to the direct supply ratio A, the carry-off supply ratio B is used, which is defined as the ratio (0<B<1) of an amount of fuel carried off during the present cycle from fuel (Fw) adhering to the wall surfaces of the intake port before the present injection into the combustion chamber of the cylinder through evaporation and other factors to an amount of the fuel (Fw) adhering to the wall surfaces up to the immediately preceding cycle. Although the fact that (A×Tout) represents an amount of fuel directly supplied to the cylinder without adhering to the wall surfaces of the intake port and ((1−A)×Tout) represents the adherent fuel increment Fwin also applies to the second method, it is here considered that the carried-off fuel amount Fwout forms a portion of B×Fw out of the fuel Fw adhering to the wall surfaces before the present injection.

As shown in Equation (1), the required fuel amount Tcyl is calculated as follows:

$$Tcyl=A\times Tout+Fwout$$

provided that Fwout=B×Fw

The amount Fw(n) of fuel adhering to the wall surfaces after the present injection is changed from the amount Fw(n-1) of fuel adhering to the wall surfaces before the present injection by an incremental amount of the difference between the adherent fuel increment Fwin and a decremental amount of the carried-off adherent fuel Fwout. Therefore, there holds Equation (6):

$$\begin{aligned} Fw(n) &= Fw(n-1)+Fwin-Fwout \\ &= Fw(n-1)+(1-A)\,Tout-B\times Fw(n-1) \\ &= (1-A)\times Tout+(1-B)\times Fw(n-1) \end{aligned} \quad (6)$$

Further, the fuel injection amount Tout can be calculated by transforming the above Equation (1) to Equation (7):

$$Tout=(Tcyl-Fwout)/A=(Tcyl-B\times Fw)/A \quad (7)$$

Thus, the fuel injection amount Tout corrected for the fuel transfer delay, i.e. for an amount B×FW of fuel indirectly supplied to the cylinder can be obtained from Equations (6) and (7).

Figure 5:
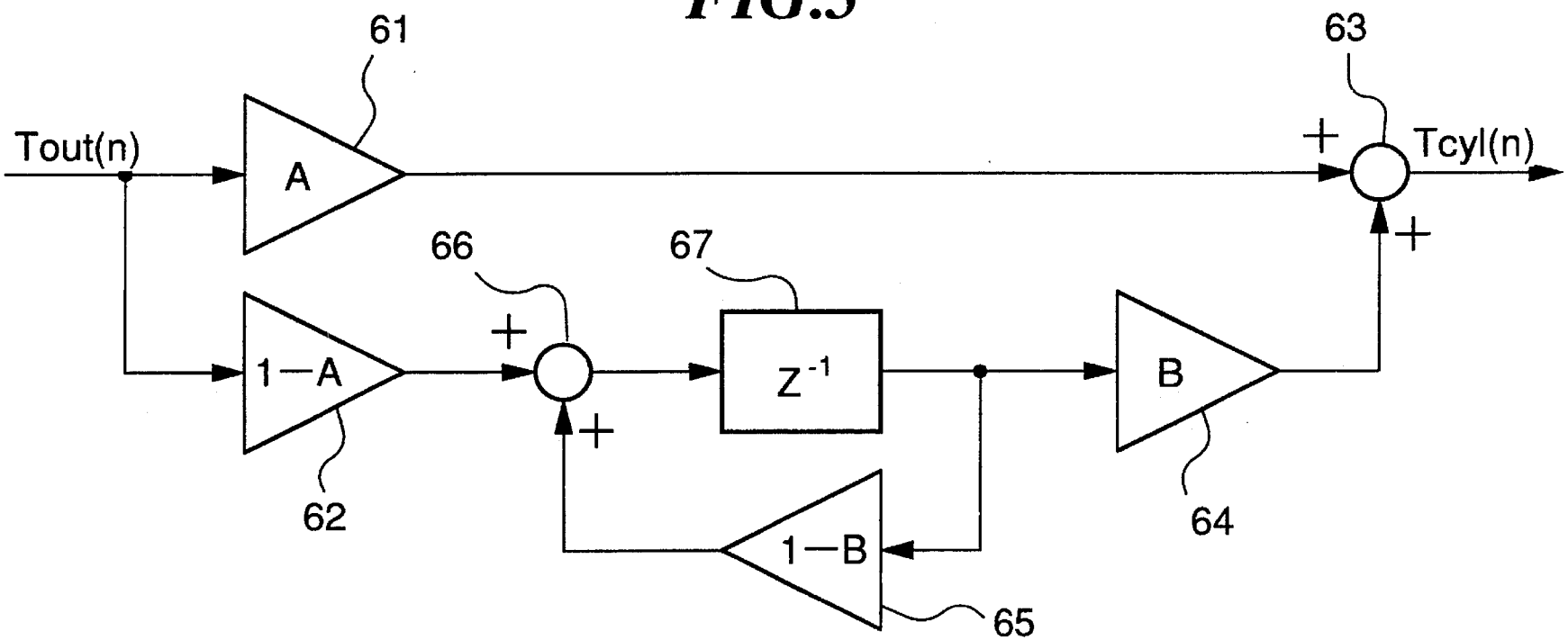
FIG. 5 is a schematic representation of a physical model circuit modeled on fuel transfer delay-dependent correction of the fuel injection amount according to an AB method.

FIG. 5 schematically represents a physical model circuit modeled on the fuel transfer delay-dependent correction of the fuel injection amount according to the second method described above (hereinafter referred to as the AB method).

In the figure, the fuel injection amount Tout(n) injected via the fuel injection valve 6 for the present cycle (n) is multiplied by the direct supply ratio A at a multiplier 61, while it is also multiplied by (1−A) at a multiplier 62. The multiplier 61 delivers an output of (A×Tout(n)) to an adder 63, where the value (A×Tout(n)) is added to the carried-off fuel amount Fwout(n) for the present cycle delivered from a multiplier 64 which multiplies an input thereto by the carry-off supply ratio B, to thereby determine the required fuel amount Tcyl for the present cycle.

As described above, according to the AB method, it is considered that the carried-off fuel amount Fwout forms B×Fw of the fuel Fw adhering to the wall surfaces before the present injection. Therefore, the multiplier 64 is supplied with the adherent fuel amount Fw(n) before the present injection, i.e. at the start of the present cycle. Further, a multiplier 65 multiplies the adherent fuel amount Fw(n) by (1−B) and the resulting product (1−B)×Fw(n) is supplied to an adder 66.

On the other hand, the multiplier 62 delivers an output which indicates the adherent fuel increment Fwin(n)=(1−A)×Tout(n) corresponding to Equation (3) to the adder 66, where the adherent fuel increment is added to the output from the multiplier 65, i.e. (1−B)×Fw(n). The sum forms the adherent fuel amount Fw(n+1) for the subsequent cycle, i.e. an amount of fuel adhering to the wall surfaces after the present injection. The adherent fuel amount Fw(n+1) for the next cycle of the cylinder is supplied to a cycle-delaying circuit 67, which delays an input thereto by one cycle and then supplies same to the multipliers 64 and 65.

That is, from the adherent fuel amount Fw(n) accumulated and remaining on the wall surfaces at the start of the present cycle, an amount of (B×Fw(n)) is carried off, which is calculated at the multiplier 64, and the remaining amount (1−B)×Fw(n) is added by the adder 66 to the adherent fuel increment Fwin(n) for the present cycle or after the present injection.

Therefore, the adherent fuel amount Fw(n+1) remaining at the start of the next cycle of the cylinder, i.e. the output (=Fw(n+1))from the adder 66 can be obtained by the following equation:

$$\begin{aligned} Fw(n+1) &= Fwin(n) + (1-B) \times Fw(n) \\ &= (1-A) \times Tout(n) + (1-B) \times Fw(n) \\ &= Fw(n) + (1-A) \times Tout(n) - B \times Fw(n) \end{aligned} \quad (8)$$

In an example described in detail hereinafter, the AT method is used.

Next, the principle of the fuel transfer delay-dependent correction of the fuel injection amount carried out with unburnt fuel (unburnt HC) taken into account will be described.

As described before, part of the fuel supplied to the cylinder remains unburnt. Therefore, to stabilize the air-fuel ratio (A/F) within the cylinder, the fuel. transfer delay-dependent correction of the fuel injection amount by the first or second method alone described above does not suffice. Therefore, it is necessary to carry out fuel transfer delay-dependent correction with the unburnt HC components taken into account (unburnt HC-dependent correction).

A first method of the unburnt HC-dependent correction will be described with reference to FIG. 6A.

Figure 6A:
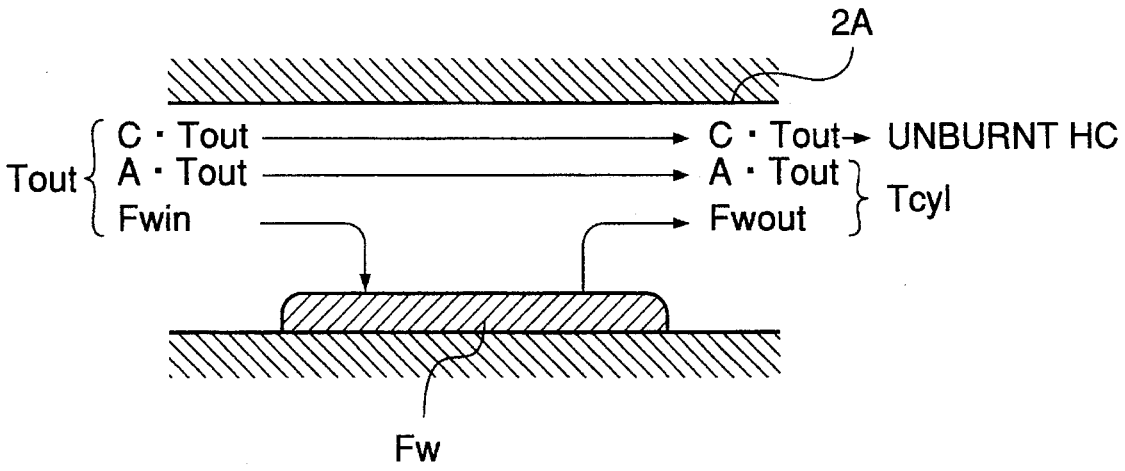
FIG. 6A and FIG. 6B are diagrams which are useful in explaining the concepts of methods of unburnt HC-dependent correction of the fuel injection amount.

According to the first method, as shown in FIG. 6A, out of the amount Tout of fuel injected from the fuel injection valve 6, an amount of the sum of A (direct supply ratio)× Tout and C (unburnt fuel ratio)×Tout is directly drawn into the cylinder, and the remaining fuel, i.e. the adherent fuel increment Fwin is added to the adherent fuel amount Fw. A×Tout and the amount Fwout carried off the adherent fuel amount Fw form the required fuel amount Tcyl which contributes to combustion in the cylinder, while C (unburnt fuel ratio)×Tout forms a portion of fuel which is not used in combustion, i.e. unburnt HC components.

The first method can be expressed by the use of the following mathematical expressions:

The required fuel amount Tcyl is expressed as below:

$$Tcyl = A \times Tout + Fwout$$

The adherent fuel increment Fwin is expressed as below:

$$Fwin = (1-A-C) \times Tout$$

If this method is applied to the AT method, in which the required fuel amount Tcyl is calculated as follows:

$$Tcyl = A \times Tout + Fwout$$

the carried-off fuel amount Fwout(n) for the present cycle or obtained after the present injection is calculated from the following equation:

$$\begin{aligned} Fwout(n) &= Fwout(n-1) + (1/T) \times \\ &\quad (Fwin(n-1) - Fwout(n-1)) \\ &= Fwout(n-1) + (1/T) \times \\ &\quad \{(1-A-C) \times Tout(n-1) - \\ &\quad Fwout(n-1)\} \end{aligned}$$

On the other hand, if the first method is applied to the AB method, in which the required fuel amount Tcyl is calculated as follows:

$$Tcyl = A \times Tout + B \times Fw$$

the adherent fuel amount Fw(n) for the present cycle or obtained after the present injection is calculated by the following equation:

$$Fw(n) = Fw(n-1) + (1-A-C)Tout - B \times Fw(n-1)$$

Next, the second method of the unburnt HC-dependent correction will be described with reference to FIG. 6B.

While the first method considers that part of the fuel injection amount Tout via the fuel injection valve 6, which is directly drawn into the cylinder, contains unburnt HC components, the second method considers that the amount Fwout of fuel carried off the adherent fuel amount Fw into the cylinder contains unburnt HC components.

Figure 6B:
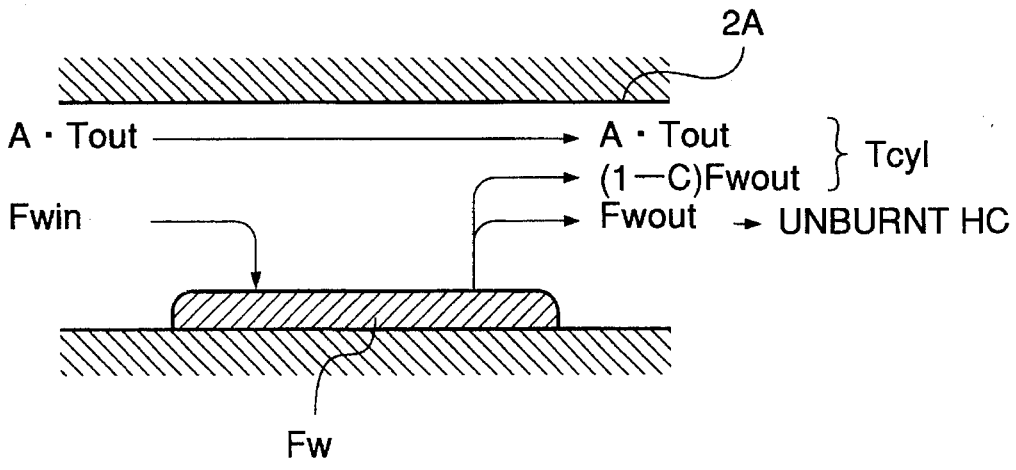

More specifically, as shown in FIG. 6B, out of the fuel injection amount Tout via the fuel injection valve 6, A (direct supply ratio)×Tout is directly drawn into the cylinder, and the remainder or adherent fuel increment Fwin is added to the adherent fuel amount Fw. Further, out of the carried-off fuel amount Fwout carried away from the adherent fuel amount Fw, C×Fwout is considered to form unburnt HC components, and the remainder (1−C)×Fwout and A×Tout is supplied to the cylinder as the required fuel amount Tcyl which contributes to combustion in the cylinder.

The second method can be expressed by the use of the following mathematical expressions:

The required fuel amount Tcyl is expressed as below:

$$Tcyl = A \times Tout + (1-C) \times Fwout$$

and hence the fuel injection amount Tout is expressed as below:

$$Tout = (Tcyl - (1-C) \times Fwout)/A$$

If the second method is applied to the AT method described above, the carried-off fuel amount Fwout for the present injection is calculated as follows:

$$\begin{aligned} Fwout(n) &= Fwout(n-1) + \\ &\quad (1/T) \times (Fwin(n-1) - Fwout(n-1)) \\ &= Fwout(n-1) + (1/T) \times \{(1-A-C) \times \\ &\quad Tout(n-1) - Fwout(n-1)\} \end{aligned}$$

If the second method is applied to the AB method, the carried-off fuel amount Fwout for the present injection corresponds to B×Fw in the following equation:

$$Tcyl = A \times Tout + B \times Fw,$$

the adherent fuel amount Fw(n) for the present cycle is expressed as follows:

$$Fw(n) = Fw(n-1) + (1-A) \times Tout(n) - B \times Fw(n-1)$$

Next, description will be made of the fuel transfer delay-dependent correction of the fuel injection amount with the air-fuel ratio feedback control using the air-fuel ratio coefficient KO2 (referred to hereinafter as "the O2 feedback control") taken into account. According to the O2 feedback control, the air-fuel ratio correction coefficient KO2 is calculated based on an output from the O2 sensor (air-fuel ratio sensor) 22 arranged in the exhaust passage of the engine at a location upstream of the catalytic converter 23, and the fuel injection amount Tout is determined based on the KO2 value.

The fuel transfer delay-dependent correction of the fuel injection amount alone does not suffice to ensure that the air-fuel ratio of a mixture supplied to the engine is properly controlled to a desired air-fuel ratio. For example, if the fuel injection valve 6 has operating characteristics different from proper ones, or if the reference pressure level set to the pressure regulator of the fuel pump 8 deviates from a proper value, there arises an error in the fuel injection amount Tout, even if fuel is injected by a pulse having an accurate pulse width. Similarly, a difference in charging efficiency (intake air amount) between individual engines due to manufacturing tolerances or aging of the engine can result in a large deviation of the basic fuel injection amount determined based on a basic fuel injection amount Ti map according to the engine rotational speed NE and the intake pipe absolute pressure PBA from a proper value, and hence in an error in the fuel injection amount Tout.

To avoid such inconveniences, as mentioned before, the first method and the second method have been conventionally proposed by Japanese Provisional Patent Publications (Kokai) No. 58-8238 and No. 61-126337 to carry out fuel transfer delay-dependent correction of the fuel injection amount Tout by taking into account the air-fuel ratio correction coefficient KO2 set by integrating terms or coefficients and variables for correcting an error in the fuel injection amount Tout caused by errors on the fuel injection valve side and manufacturing tolerances or aging of the engine.

Figure 7:
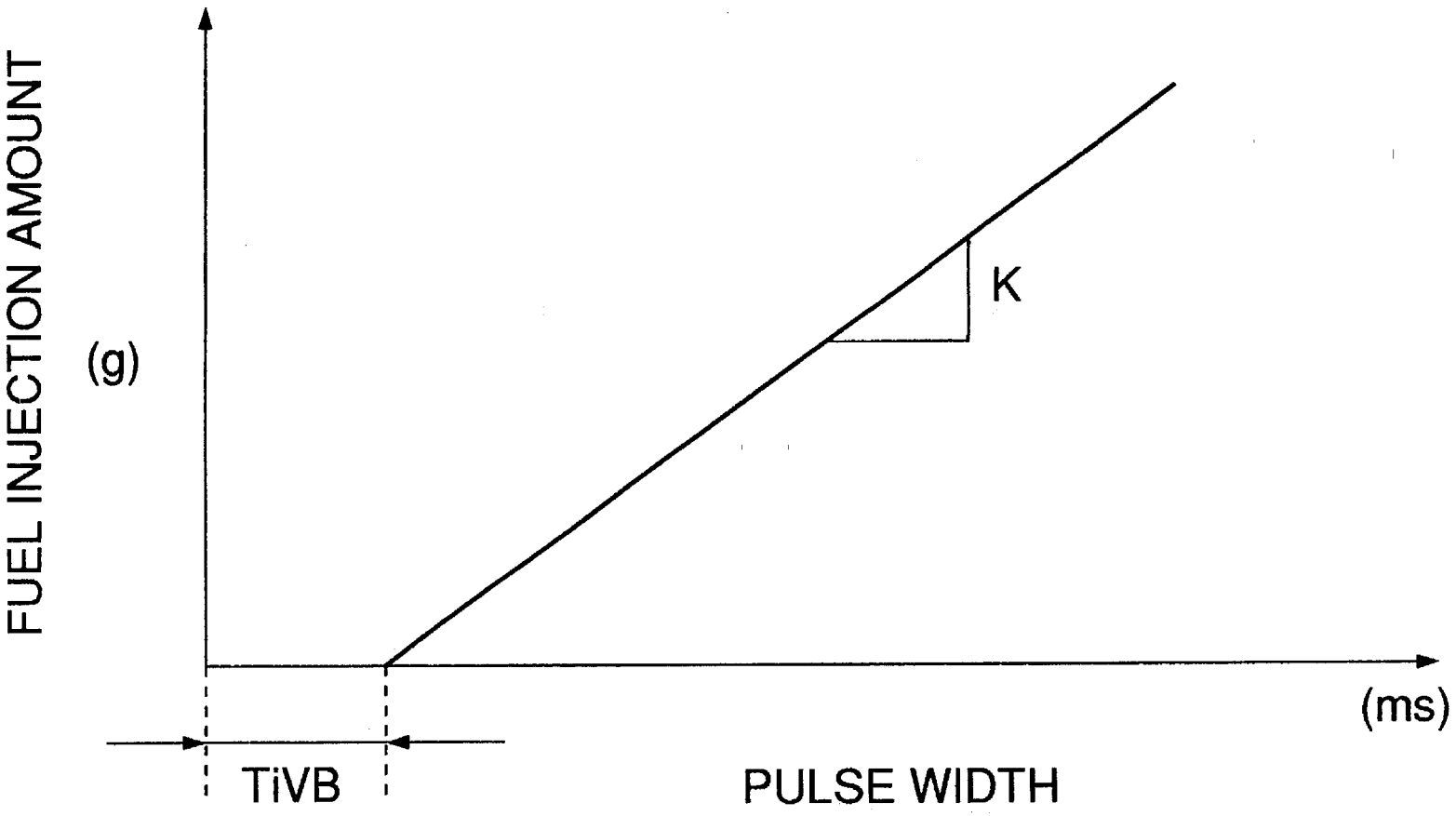
FIG. 7 is a diagram showing an operating characteristic of a fuel injection valve.

As to the correction of errors on the fuel injection valve side, as shown in FIG. 7 in which operating characteristics (K and TiVB) of the fuel injection valve 6 are depicted, a real or physical amount (g) of fuel injection is not corrected but merely the operating characteristics (TiVB and K indicated in FIG. 7) of the fuel injection valve are corrected. TiVB in FIG. 7 represents an ineffective time period before the fuel injection valve opens in response to a driving pulse, which is set depending upon the voltage of a battery, not shown, of the engine.

However, the first and second methods suffer from the problems described in detail before.

To overcome these problems, according to the present embodiment, a carried-off fuel amount correction coefficient f(KO2) is introduced, which is set to a smaller value as the value of the correction coefficient KO2 becomes larger.

When the first method. is employed, the following correction is effected:

$$Tout = [Tcyl \times KO2 - Fwout \times f(KO2)]/A \quad (9)$$

While the second method is employed, the following correction is effected:

$$Tout = [(Tcyl - Fwout) \times f(KO2)]/A \times KO2 \quad (10)$$

Here, the carried-off fuel amount correction coefficient f(KO2) is more specifically expressed by the following equation:

$$f(KO2) = 1 + \alpha \times (1 - KO2) \quad (11)$$

or by the following equation:

$$f(KO2) = \alpha / KO2 \quad (12)$$

where α represents an f(KO2)-setting coefficient.

Figure 8A:
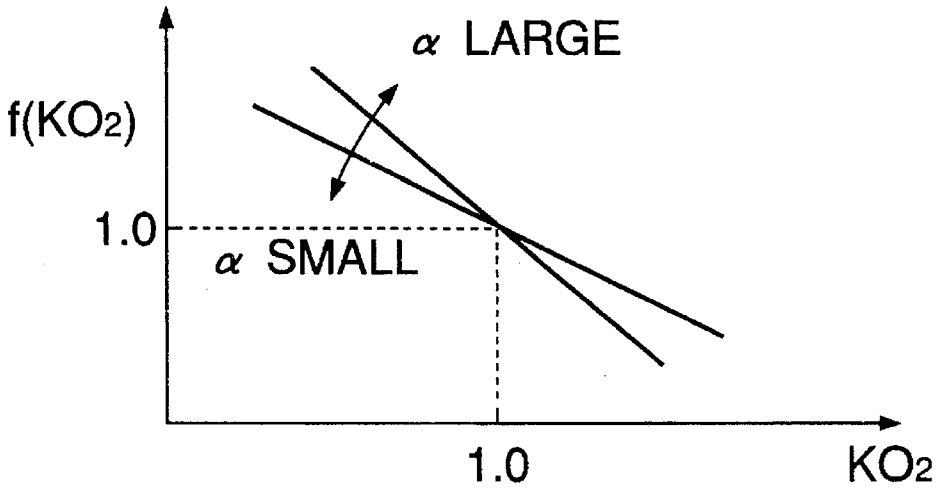
FIG. 8A and FIG. 8B are diagrams showing relationships between a carried-off fuel amount correction coefficient f(KO2), and the air-fuel ratio correction coefficient KO2, depending on a f(KO2)-setting coefficient $\alpha$.
Figure 8B:
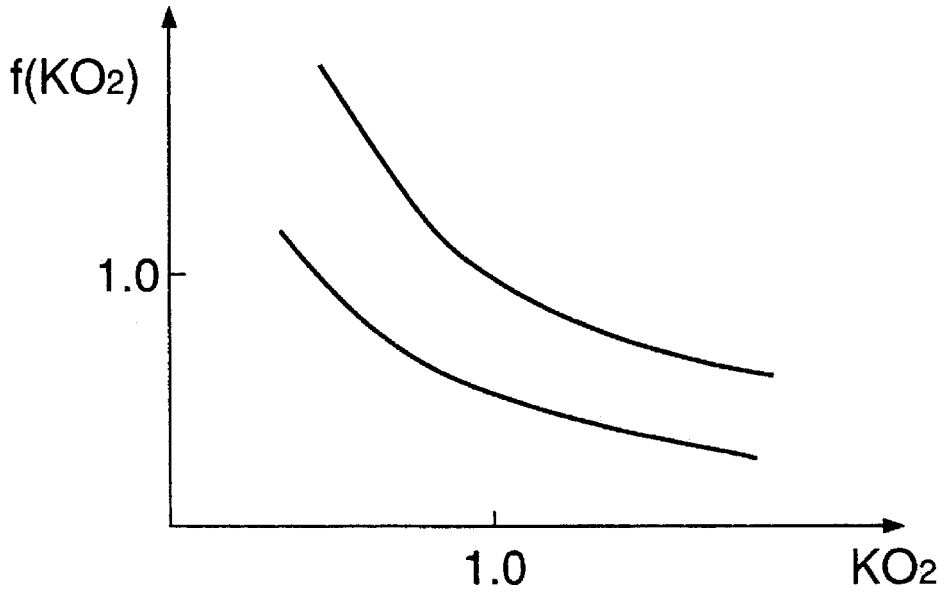

In the above Equation (11), as shown in FIG. 8A, f(KO2) is equal to 1 when KO2=1.0, and the inclination of this function f(KO2), which can be depicted as a straight line falling rightward in relation to the value of KO2, varies with the f(KO2)-setting coefficient α for setting the carried-off fuel amount correction coefficient f(KO2). In Equation (12), this function can be expressed as a hyperbola falling rightward.

Further, the f(KO2)-setting coefficient α is set to a larger value when the direct supply ratio A is smaller as in the case of a low engine coolant temperature. That is, the direct supply ratio A becomes smaller as the engine coolant temperature is lower, so that the carried-off fuel amount Fwout supplied from the adherent fuel amount Fw to the cylinder becomes fairly larger than the amount (A×Tout) of fuel injected and directly drawn into the cylinder, whereby the carried-off fuel amount Fwout has greater influence on the fuel injection amount Tout. This can result in an increased degree of hunting of the KO2 value. Therefore, when the direct supply ratio A is smaller, the f(KO2)-setting coefficient α is set to a larger value to effect a larger correction.

Next, a manner of estimating the wall temperature of the intake pipe or intake port will be described.

Figure 9:
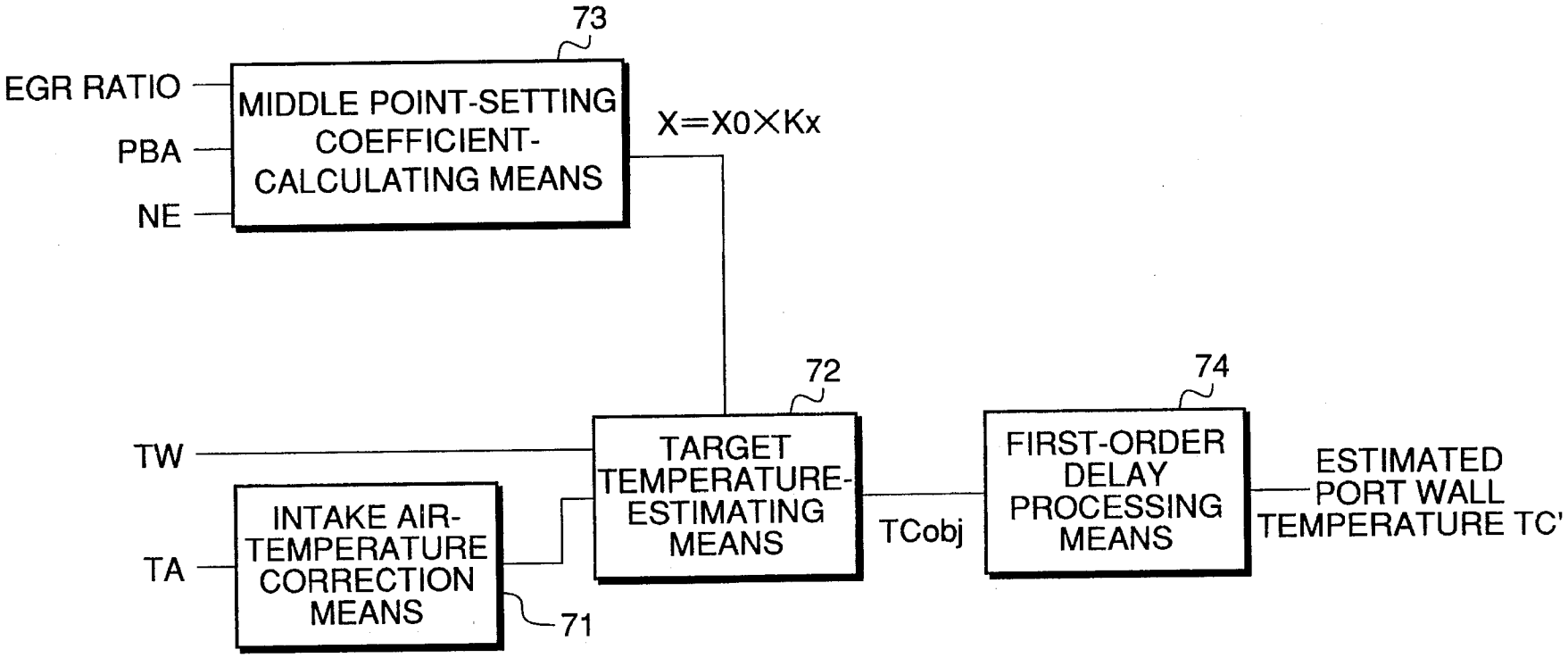
FIG. 9 is a schematic block diagram showing the construction of an intake passage wall temperature-estimating device according to an embodiment of the invention.

FIG. 9 shows the construction of an intake passage wall temperature-estimating device.

The intake passage wall temperature-estimating device estimates the port wall temperature TC based the parameters input thereto, i.e. an EGR ratio, the intake pipe negative pressure PB, the engine rotational speed NE, the engine coolant temperature TW, and the intake air temperature TA.

The intake air Temperature TA is supplied to intake air-dependent correction means 71, which corrects a response delay of the TA sensor 13, i.e. a delay in the output therefrom. The response delay of the TA sensor 13 is caused by the thermal capacity of the TA sensor 13 itself which prevents the TA sensor 13 from immediately responding to a drastic change in the intake air temperature.

The response delay of the TA sensor 13 is corrected by the use of the following equation:

$$TA' = TA(n-1) + K \times (TA(n) - TA(n-1)) \quad (13)$$

That is, a difference between the present output TA(n) from the TA sensor 13 and the immediately preceding output TA(n−1) from same is multiplied by a predetermined correction coefficient K, and the resulting product is added to the immediately preceding output TA(n−1) to obtain the corrected intake air temperature TA'.

Then, target temperature-estimating means 72 estimates a target temperature TCobj of the wall of the intake port based on the corrected intake air temperature TA' and the engine coolant temperature TW. More specifically, the target temperature-estimating means 72 estimates the target temperature TCobj as an intermediate temperature between the corrected intake air temperature TA' and the engine coolant temperature TW by the use of the following equation:

$$TCobj=X\times TA'+(1-X)\times TW \quad (14)$$

where X represents a middle point-setting coefficient for setting an interior division factor or ratio for determining a middle point between the corrected intake air temperature TA' and the engine coolant temperature TW.

The middle point-setting coefficient X is calculated based on the intake air flow rate [1/min] determined as a main factor, based on the intake pipe negative pressure PB and the engine rotational speed NE with the EGR rate taken into account, by the use of the following equation:

$$X=X0\times Kx \quad (15)$$

where X0 represents a map value of the middle point-setting coefficient retrieved from a NE-PB map according to the engine rotational speed NE and the intake pipe negative pressure PB, which assumes a value in the range of $0<X0<1$. Further, Kx represents an interior division factor correction coefficient which is retrieved from a Kx table according to the lift amount LACT of the EGR valve 26.

Figure 10:
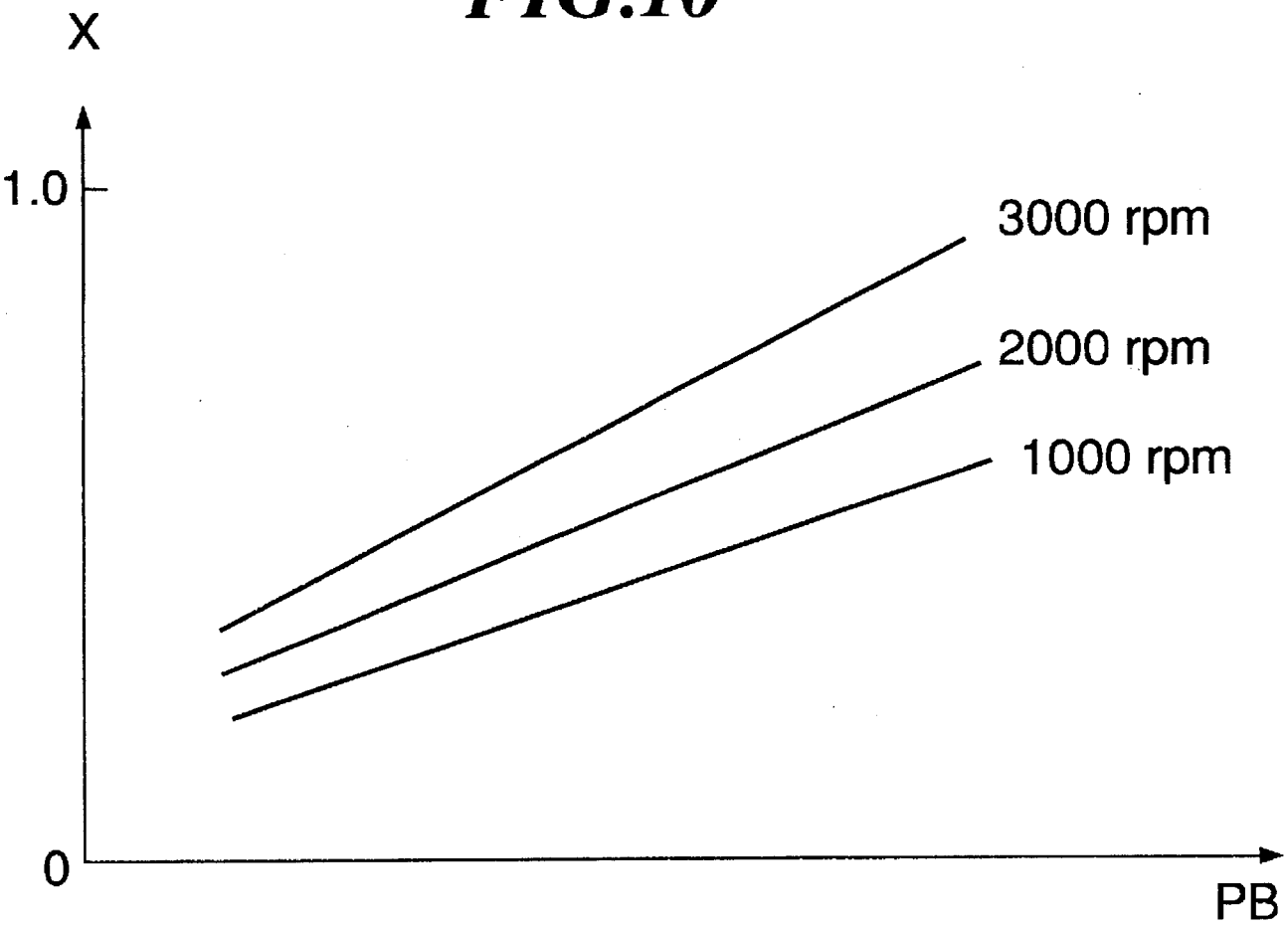
FIG. 10 is a diagram showing the relationship between a middle point X, and the intake pipe negative pressure PB and the engine rotational speed NE.

The middle point-setting coefficient X thus obtained exhibits a tendency relative to the intake pipe negative pressure PB and the engine rotational speed NE as shown in FIG. 10.

The middle point-setting coefficient X is determined, in the above example, by the use of the intake air flow rate as a main factor. The reason for this will be described below.

For example, when the intake pipe negative pressure PB is small and the engine rotational speed NE is high, i.e. when the engine is in a high load and high engine speed condition, the intake air amount per unit time increases, so that the engine is cooled by the intake air to cause the intake port wall temperature to become closer to the intake air temperature. Inversely, when the engine is in a low load and low engine speed condition, the intake air amount per unit time decreases, so that the intake port wall temperature TC is more readily influenced by heat generated by the engine and rises to a value close to the engine coolank temperature TW.

The present embodiment contemplates such characteristics of the port wall temperature TC, and uses the interior division factor, i.e. the middle point-setting coefficient X in determining the target wall temperature TCobj as an intermediate point between the corrected intake air temperature TA' and the engine coolant temperature TW, which makes it possible to determine the target wall temperature TCobj with accuracy.

Further, the EGR ratio Kx is additionally used in determining the interior division factor, because the exhaust side of the engine is higher in temperature than the intake side thereof, so that the intake port wall temperature TC rises to a higher temperature as the EGR ratio is higher. The present embodiment also contemplates this fact, and determines the interior division factor such that as the EGR ratio Kx is higher, the intake port wall temperature TC is estimated at a higher value, which makes it possible to determine the target wall temperature TCobj with more accuracy.

Further, when the engine is in a transient operating condition, the intake port wall temperature TC exhibits a delay in response to a change in the operating condition of the engine.

Figure 11:
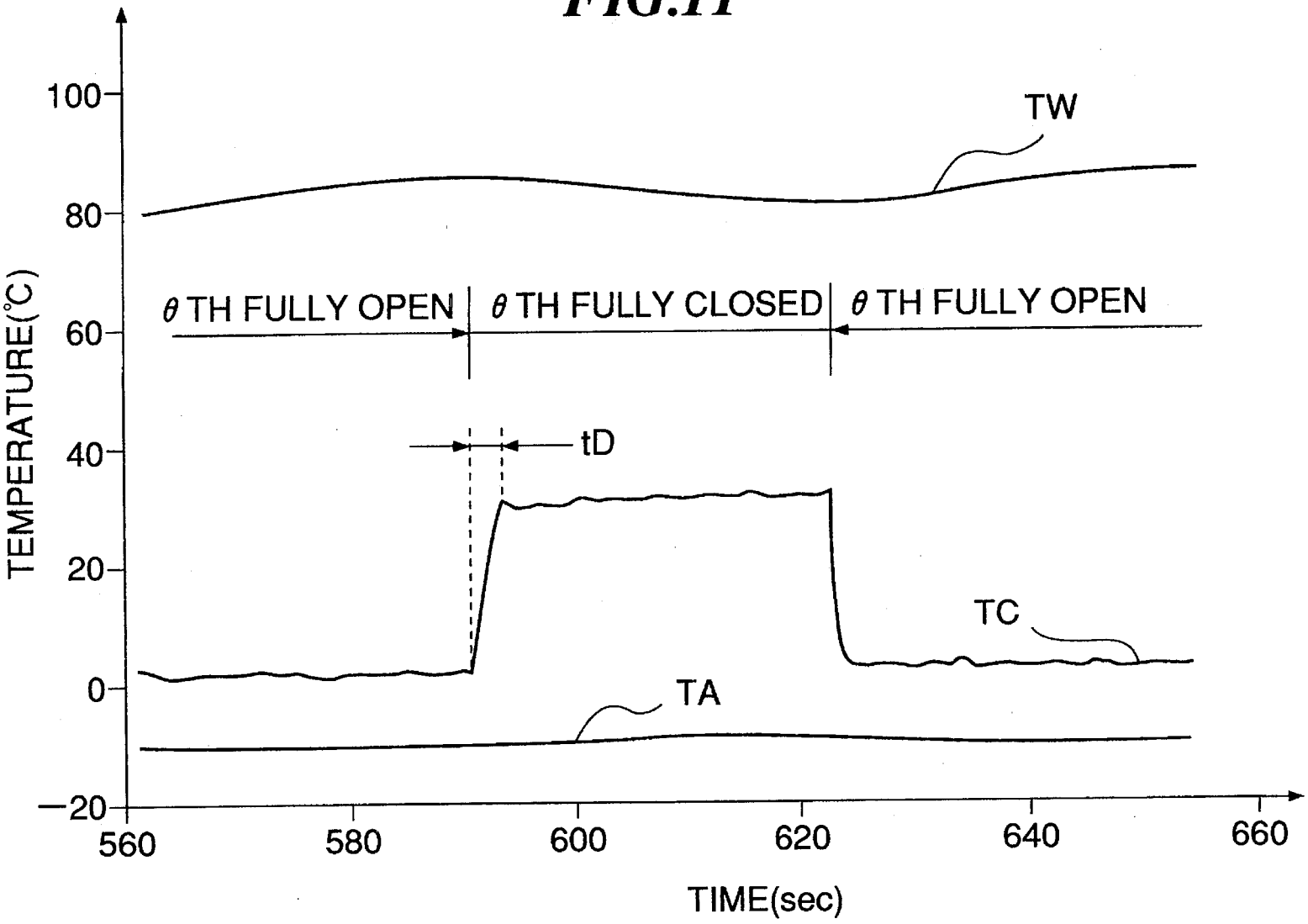
FIG. 11 is a diagram which is useful in explaining a response delay of the intake port wall temperature TC exhibited under a transient operating condition of the engine.

FIG. 11 shows an example of a change in the intake port wall temperature TC which shows a delay in response to a change in the operating condition of the engine. In the figure, a change in the intake port wall temperature TC is depicted in relation to the engine coolant temperature TW and the intake air temperature TA as the throttle valve 3' is operated such that it is fully opened, then fully closed, and finally fully opened. In this example, it is assumed that the intake port wall temperature TC and the intake air temperature TA are detected by respective sensors which are free of delay in the sensor response.

As shown in the figure, when the engine is in a warmed-up condition (i.e. the engine coolant temperature TW is higher than 80 °C.), if the throttle valve 3' is in a fully open position, the outside air (in this example, at a temperature of approximately −10 °C.) flows into the cylinder via the intake pipe 2 at a large flow rate, so that the intake port wall temperature TC varies within a low temperature range of 2 to 3 °C.). If the throttle valve 3' is fully closed thereafter, the intake port wall temperature TC largely increases due to influence of heat generated by the engine. However, the manner of increase in the intake port wall temperature TC is such that due to the thermal capacity of the intake air port 2A, the intake port wall temperature does not instantly rise to a predetermined stable level (in this example, approximately 30 °C.), but it reaches the predetermined stable value with a time delay tD after the throttle valve 3' becomes fully closed.

The construction of the intake passage wall temperature-estimating device of the present embodiment will be further described by further referring to the above example shown in FIG. 11. As described above, the target wall temperature TCobj is basically determined based on the engine coolant temperature TW and the corrected intake air temperature TA'. The engine coolant temperature TW and the corrected intake air temperature TA' assume substantially constant values, and the interior division factor therebetween varies mainly according to the intake pipe negative pressure PB and the engine rotational speed NE. Therefore, when the engine is in a transient condition in which the throttle valve 3' is changed from a fully open position to a fully closed position, the intake pipe negative pressure PB drastically drops and accordingly the target wall temperature TCobj is set to a higher value. On this occasion, to compensate for the response delay (tD), first-order delay processing means 74 effects a first-order delay to the target wall temperature TCobj, to thereby finally determine an estimated port wall temperature TC'.

The first-order delay processing means 74 determines the estimated port wall temperature TC' at an intermediate point between the immediately preceding value TC'(n−1) and the target wall temperature TCobj by the use of the following equation:

$$TC'(n)=\beta\times TC'(n-1)\times(1-\beta)\times TCobj \quad (16)$$

where β represents an averaging time constant dependent upon the response delay of the intake port wall temperature TC.

Next, an example of the fuel transfer delay-dependent correction of the fuel injection amount according to the present embodiment will be described with reference to FIG. 12 to FIG. 14.

Figure 12:
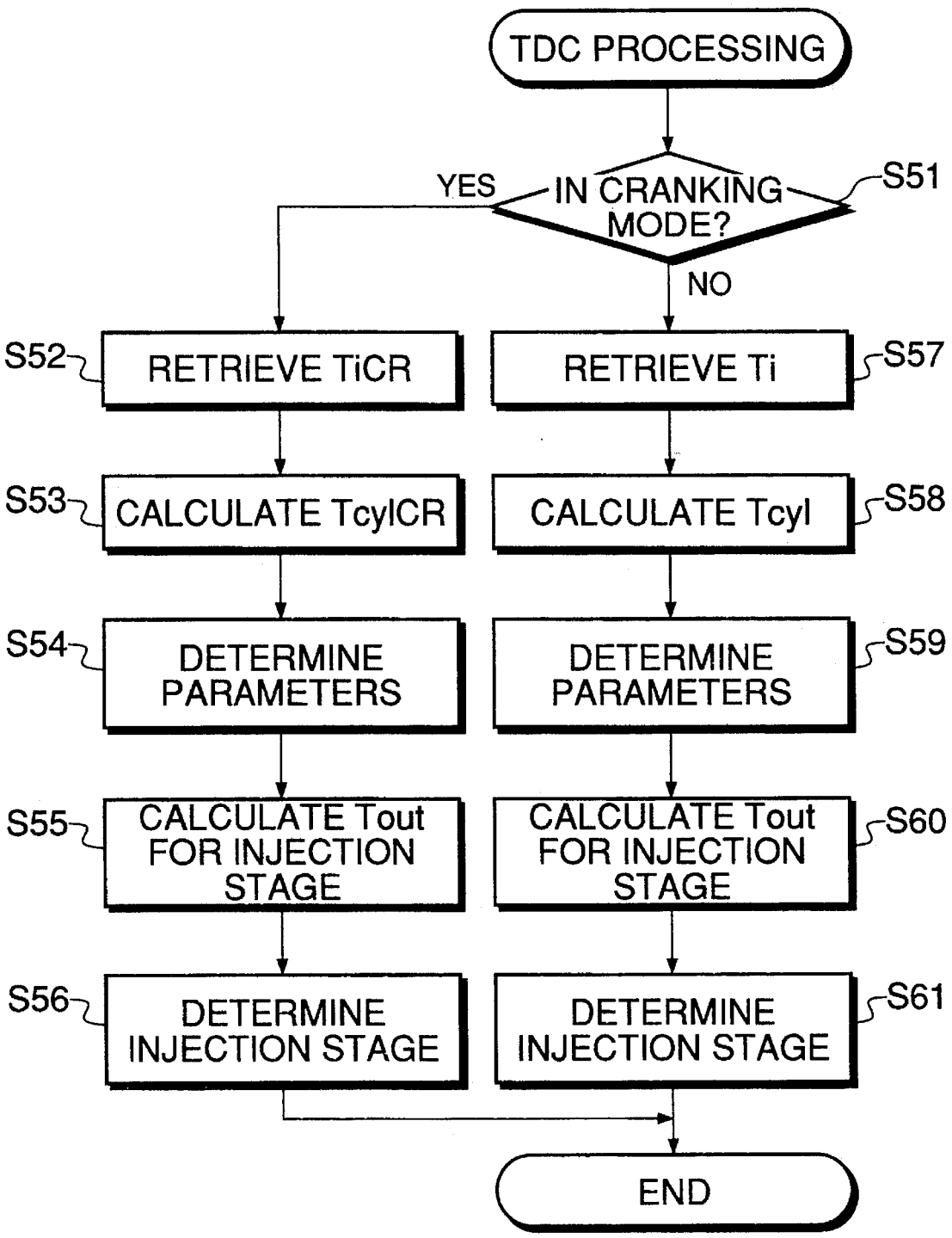
FIG. 12 is a flowchart showing a TDC processing routine.

FIG. 12 shows a TDC processing routine executed in synchronism with generation of TDC signal pulses.

First, at a step S51, it is determined whether or not the engine is in a cranking mode. If the answer to this question is affirmative (YES), the program proceeds to a step S52, wherein a basic fuel injection amount TiCR for the cranking mode is determined based on the engine coolant temperature. Then, at the following step S53, based on the basic fuel injection amount TiCR, the required fuel amount TcylCR is calculated by the use of the following equation:

$$TcylCR=TiCR\times KNE\times KPACR \quad (17)$$

where TiCR represents the basic fuel injection amount as a function of the engine coolant temperature, KNE an engine rotational speed-dependent correction coefficient, and KPACR an atmospheric pressure-dependent correction coefficient.

Further, at a step S54, the direct supply ratio A, the delay time constant T, and an unburnt fuel ratio C1 for the cranking mode are determined by subroutines described hereinafter. Then, at a step S55, the fuel injection period Tout for determining an injection stage in the cranking mode is calculated by the use of the following equation:

$$Tout=(TcylCR-Fwout)/A+TiVB \quad (18)$$

where TiVB represents the ineffective time period of the fuel injection valve.

AT a step S56, based on the fuel injection amount for determining the injection stage in the cranking mode, the fuel injection stage is determined by the use of the following equation:

$$\text{Injection stage}=(\text{final stage})-Tout/CRME \quad (19)$$

where CRME represents an average CRK pulse interval [ms], followed by terminating the program.

When the engine enters the normal mode after cranking, and the answer to the question of the step S51 becomes negative (NO), the program proceeds to a step S57, wherein a map value of the basic fuel injection amount (map value) Ti is determined by retrieval of a Ti map according to the engine rotational speed NE and the intake pipe negative pressure PB. At the following step S58, the required fuel amount Tcyl is calculated by the use of the following equation:

$$Tcyl=Ti\times KTOTAL \quad (20)$$

where Ti represents the basic fuel injection amount (map value), and KTOTAL represents coefficients exclusive of the air-fuel ratio correction coefficient KO2.

More specifically, the coefficients KTOTAL are expressed by the following equation:

$$KTOTAL=KLAM\times KTA\times KPA \quad (21)$$

where KLAM represents a desired air-fuel ratio coefficient, KTA an intake air temperature-dependent correction coefficient, and KPA an atmospheric pressure-dependent correction coefficient.

Further, more specifically, the desired air-fuel ratio coefficient KLAM is determined by the following equation:

$$KLAM=KWOT\times KTW\times KEGR\times KAST \quad (22)$$

where KWOT represents a high load-dependent enriching coefficient, KTW a low coolant temperature-dependent enriching coefficient, KEGR an EGR-dependent correction coefficient, and KAST a after start-dependent enriching coefficient.

Further, at a step S59, by executing subroutines referred to hereinafter, parameters indicative of the estimated port wall temperature TC, the direct supply ratio A, the delay time constant T, and an unburnt fuel ratio C2 after cranking are determined, and then at the following step S60, the fuel injection amount Tout for determining an injection stage in the normal mode after cranking is calculated by the use of the following equation:

$$Tout=[Tcyl\times KO2-Fwout\times\{1+\alpha\times(1-KO2)\}]\times(1/A)+TiVB \quad (23)$$

Then, at a step S61, the injection stage is determined similarly to the step S56, followed by terminating the program.

In calculation of the fuel injection amount Tout for determining the injection stage carried out at the steps S55 and S60, a common value is used as the carried-off fuel amount Fwout for all the cylinders, thereby simplifying the calculation processing.

Figure 13:
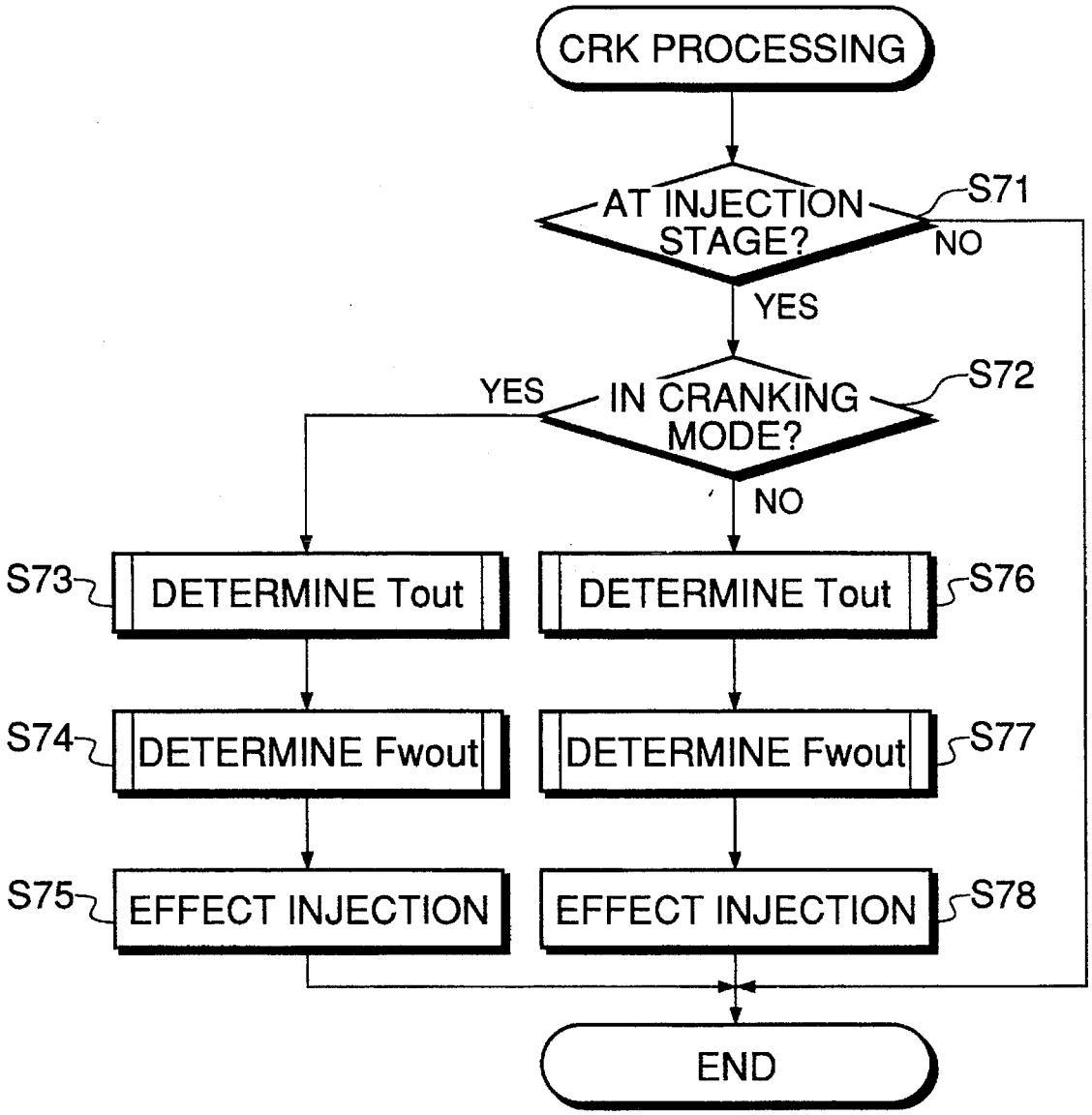
FIG. 13 is a flowchart showing a CRK processing routine.

FIG. 13 shows details of a routine for CRK processing executed in synchronism with generation of CRK signal pulses.

First, at a step S71, it is determined whether or not the present crank pulse interruption corresponds to the injection stage. If the answer to this question is negative (NO), the program is immediately terminated, whereas if the answer is affirmative (YES), the program proceeds to a step S72, wherein it is determined whether or not the engine is in the cranking mode. If the answer to this question is affirmative (YES), the program proceeds to a step S73, wherein the fuel injection amount Tout for the cranking mode is calculated separately for each cylinder, by the use of the following equation:

$$Tout\ (i)=(TcylCR(i)-Fwout(i))/T+TiVB \quad (24)$$

where TcylCR(i) is calculated by the use of the above Equation (17). In this connection, the symbol i (=1 to 4) designates correspondence to respective cylinders of #1 to #4.

Further, at a step S74, the carried-off fuel amount Fwout(n)(i) for the present cycle is determined separately for each cylinder by the use of the following equation:

$$Fwout(n)\ (i)=Fwout(n-1)(i)+(1/T)\times(Fwin(n-1)\ (i)-Fwout(n-1)\ (i)) \quad (25)$$

where the adherent fuel amount Fwin(n)(i) for the present cycle is determined by the following equation:

$$Fwin(n)\ (i)=(1-A-C1)\times(Tout(n)\ (i)-TiVB) \quad (26)$$

Thus, the fuel injection amount Tout(i) and the carried-off fuel amount Fwout(i) are calculated, and then the program proceeds to a step S75, wherein the fuel injection is carried out, followed by terminating the present program.

In addition, in an initial or first injection in the cranking mode, the adherent fuel amount Fwin before the injection is equal to zero, and hence the carried-off fuel amount Fwout is equal to 0. Therefore, it should be understood that the. carried-off fuel amount Fwout(n)(i) in the above equations represents values assumed after a second or later injection.

On the other hand, when the engine enters the normal mode after cranking, the answer to the question of the step S72 becomes negative (NO), and then the program proceeds to a step S76, wherein the fuel injection amount Tout after cranking is calculated separately for each cylinder by the use of the following equation:

$$Tout(i)=[Tcyl(i)\times KO2-Fwout(i)\times(1+\alpha\times(1-KO2))]/A+TiVB \quad (27)$$

where Tcyl(i) is calculated by the use of the above Equation (20), similarly to the step S58.

Further, at a step S77, the carried-off fuel amount Fwout(n)(i) for the present cycle is determined separately for each cylinder by the use of the above equation (25), and the adherent fuel amount Fwin(n)(i) for the present cycle is also determined by the equation (26). Thereafter, the fuel injection is carried out at a step S78, followed by terminating the program.

Figure 14:
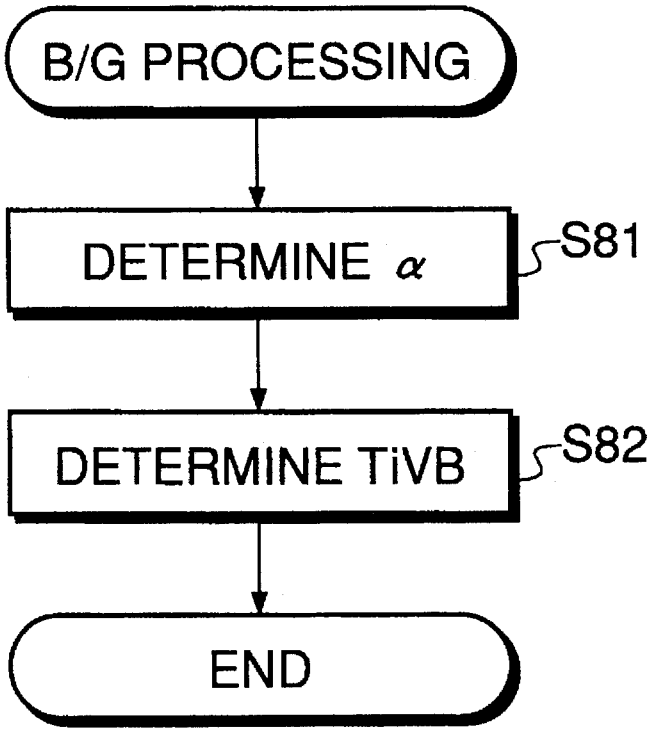
FIG. 14 is a flowchart showing a B/G (background) processing routine.

FIG. 14 shows a routine for background (B/G) processing executed in the background of the TDC processing and CRK processing.

First, at a step S81, the f(KO2)-setting coefficient $\alpha$ is determined based on a TW-$\alpha$ table, and then at a step S82, the ineffective time period TiVB is determined, followed by terminating the program.

Next, manners of calculation of the parameters executed at the steps S54 and S59 described hereinabove will be described with reference to FIG. 15 to FIG. 22.

Figure 15:
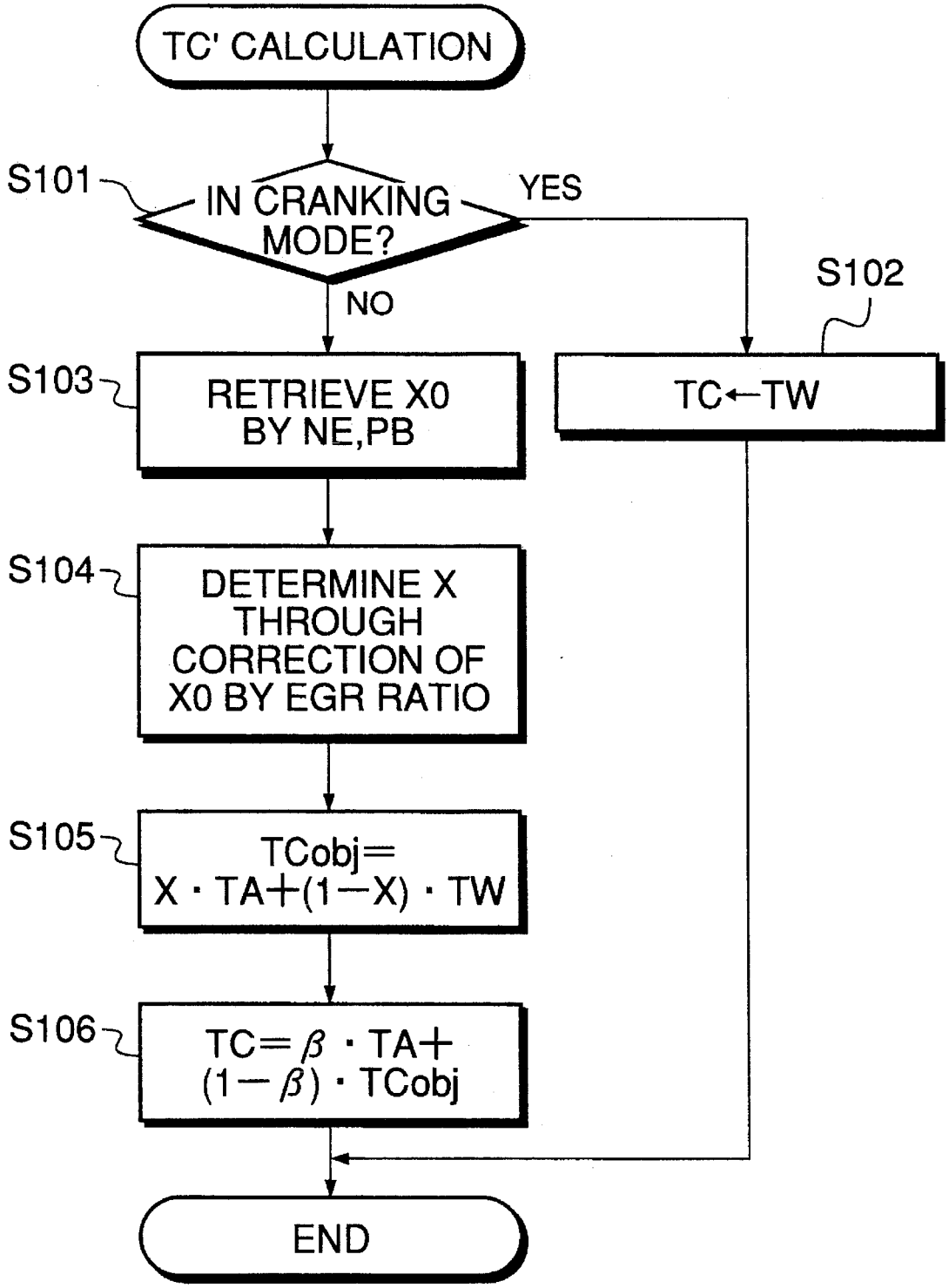
FIG. 15 is a flowchart showing an estimated intake port temperature TC'-calculating routine.

FIG. 15 shows a routine for calculating the estimated intake port wall temperature TC'.

First, at a step S101, it is determined whether or not the engine is in the cranking mode. If the answer to this question is affirmative (YES), a value of the engine coolant temperature TW detected in the present loop is set to the estimated port wall temperature TC' at a step S102, followed by terminating the program.

On the other hand, if the engine is in the normal mode after cranking, and hence the answer to the question of the step S101 becomes negative (NO), the middle point-setting coefficient X0 is read from the NE-PB map described hereinabove at a step S103, and the read middle point-setting coefficient X0 is corrected at a step S104 by the use of the EGR ratio to calculate the middle point-setting coefficient X.

Further, at a step S105, the target port wall temperature TCobj is calculated by the use of the above Equation (14), and then the estimated port wall temperature TC' is calculated by the use of the above Equation (16), followed by terminating the program.

According to the present embodiment, the difference between the corrected intake air temperature TA' and the engine coolant temperature is interiorly divided by the interior division factor dependent on the intake air amount and the EGR ratio, thereby calculating the target port wall temperature TCobj as a temperature in a steady condition of the engine, with characteristics of the port wall temperature TC taken into account. Then, the target wall temperature TCobj is subjected to delay by the first order delay processing means 74, thereby calculating the estimated port wall temperature TC' in a transient condition. Therefore, it is possible to estimate the intake port wall temperature TC more accurately than before, under all operating conditions of the engine. The estimated port wall temperature TC' thus calculated is used in calculating parameters (in the present embodiment, the direct supply ratio A and the time constant T) as described hereinafter, which are used in the fuel transfer delay-dependent correction of the fuel injection amount, thereby making it possible to effect the fuel transfer delay-dependent correction with high accuracy under all operating conditions of the engine 1.

Figure 16:
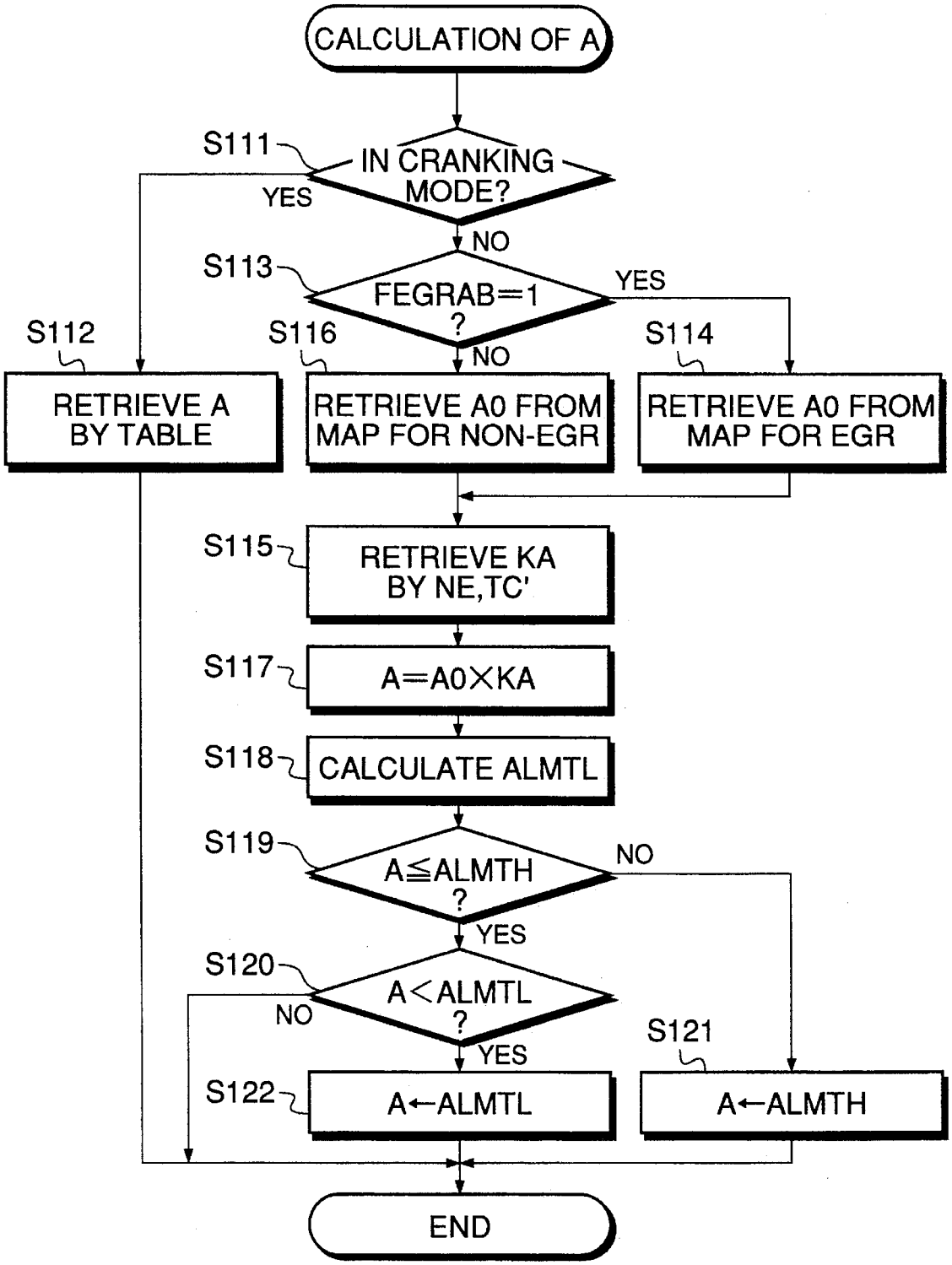
FIG. 16 is a direct supply ratio A-calculating routine.

FIG. 16 shows a routine for calculating the direct supply ratio A used in the fuel transfer delay-dependent correction of the fuel injection amount.

First, at a step S111, it is determined whether or not the engine is in the cranking mode. If the answer to this question is affirmative (YES), the program proceeds to a step S123, wherein a TW-A table, not shown, in which a map value of the direct supply ratio A is set to a larger value as the engine coolant temperature TW is higher, to determine a value of the direct supply ratio A according to the engine coolant temperature TW detected for the present loop, followed by terminating the program.

On the other hand, if the engine is operating in the normal mode after cranking, and the answer to the question of the step S111 is negative (NO), the program proceeds to a step S113, wherein a flag FEGRAB, which is set to "1" when the EGR is being carried out, is equal to "1". If the answer to this question is affirmative (YES), the program proceeds to a step S114, wherein an A0 map, not shown, for EGR condition, is retrieved according to the engine rotational speed and the intake pipe negative pressure PB to determine a value of a basic direct supply ratio A0 for EGR region, followed by the program proceeding to a step S115. On the other hand, if the answer to the question of the step S113 is negative (NO), the program proceeds to a step S116, where a A0 map, not shown, for non-EGR condition is retrieved according to the engine rotational speed NE and the intake pipe negative pressure PB to determine a value of the basic direct supply ratio A0 for non-EGR region, followed by the program proceeding to the step S115.

Figure 17:
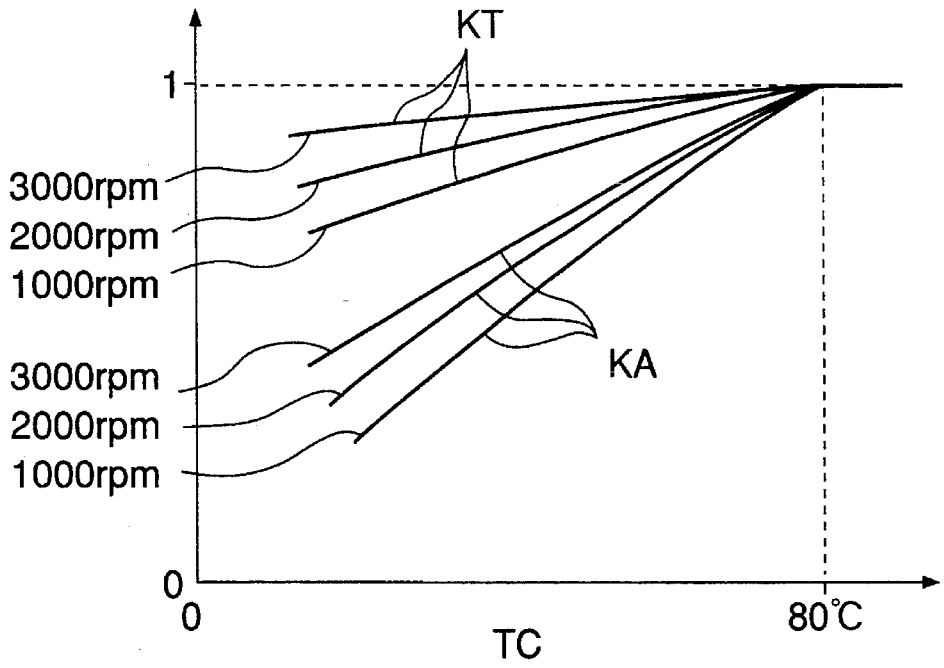
FIG. 17 is a diagram showing a KA map and a KT map.

At the step S115, a KA map shown in FIG. 17 is retrieved to determine a direct supply ratio correction coefficient KA according to the estimated port wall temperature TC' calculated by the FIG. 15 routine, and the engine rotational speed NE, and then at the following step S117, the direct supply ratio A is calculated by Equation (28):

$$A=A0\times KA \quad (28)$$

In this connection, as shown in FIG. 17, the KA map is set such that $0<KA<1$, and as the estimated wall temperature TC' is higher, the correction coefficient KA is set to a higher value.

Figure 18:
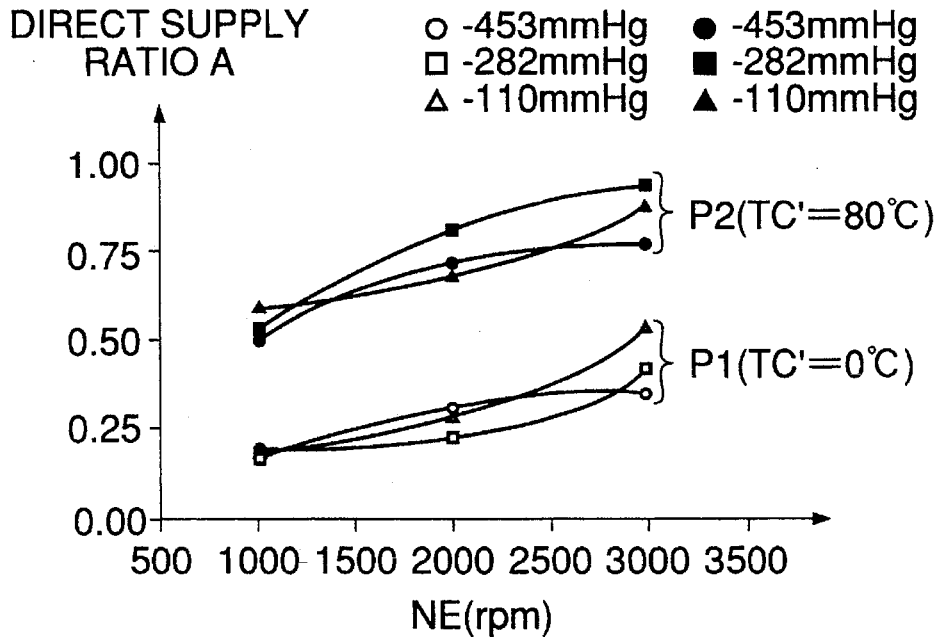
FIG. 18 is a diagram showing an example of values of the direct supply ratio A assumed under various conditions of the engine.

Further, at a step S118, a lower limit ALMTL of the direct supply ratio A is calculated, and at subsequent steps S119 to S122, limit checking of the direct supply ratio A is carried out. More specifically, if the direct supply ratio A exceeds a range defined by an upper limit value ALMTH and a lower limit value ALMT, the direct supply ratio A is set to the upper limit value at a step S121 or to the lower limit value at a step S122, followed by terminating the program. The direct supply ratio A thus determined has a tendency as depicted in FIG. 18.

Figure 19:
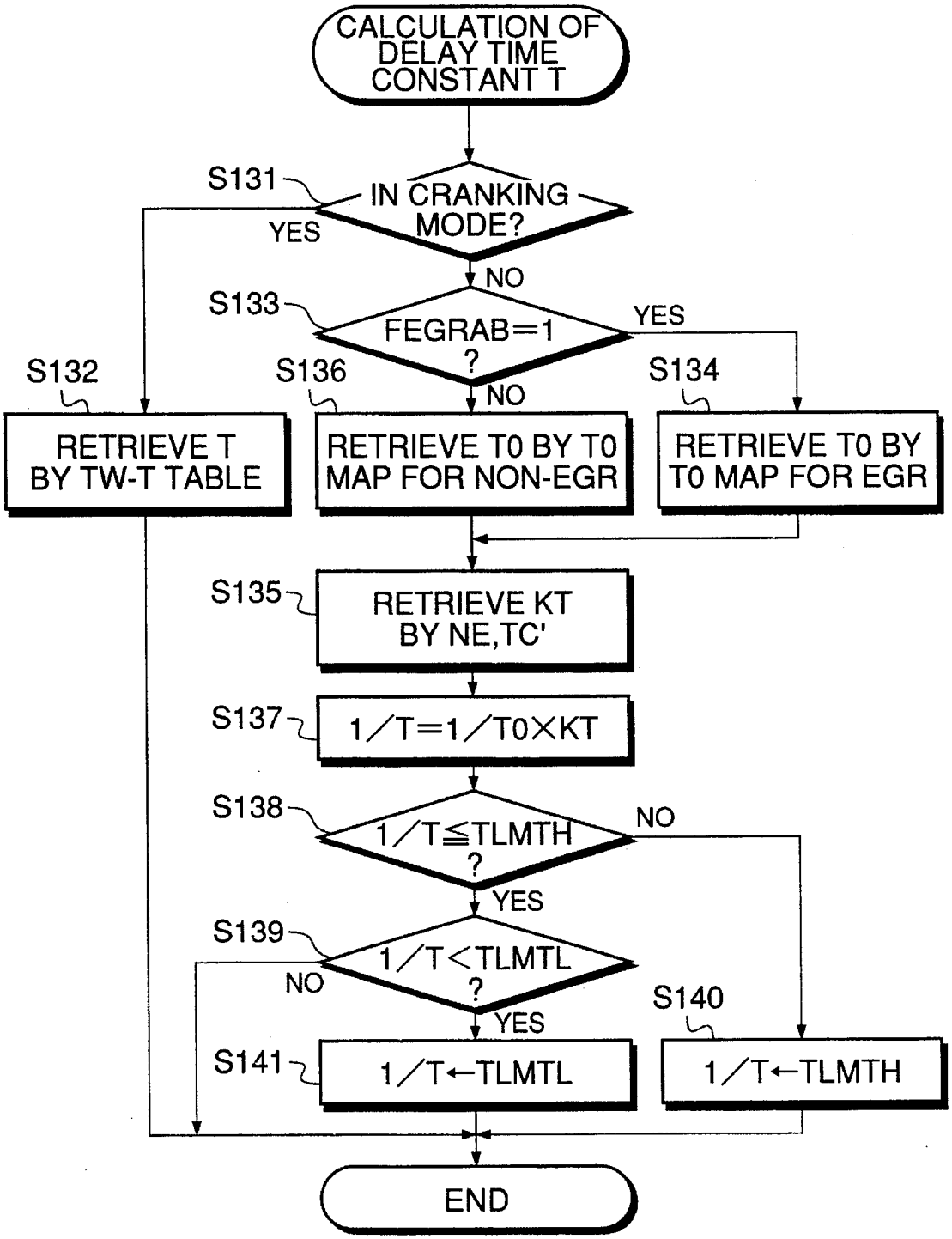
FIG. 19 is a flowchart showing a delay time constant T-calculating routine.

FIG. 19 shows a routine for calculating the delay time constant T used in the fuel transfer delay-dependent correction.

First, at a step S131, it is determined whether or not the engine is in the cranking mode. If the answer to this question is affirmative (YES), the program proceeds to a step S132, wherein a TW-T table, not shown, is retrieved to determine the delay time constant T according to the engine coolant temperature TW. The TW-T table is set such that the higher the engine coolant temperature, the larger the delay time constant T, i.e. the smaller its reciprocal 1/T.

On the other hand, if the answer to the question of the step S131 is negative (NO), the program proceeds to a step S133, wherein it is determined whether or not the flag FEGRAB is equal to "1" If the answer to this question is affirmative (YES), the program proceeds to a step S134, wherein a T0 map for EGR condition, not shown, is retrieved according to the engine rotational speed NE and the intake negative pressure PB to determine a basic delay time constant T0 for EGR region, followed by the program proceeding to the step S135.

Further, if the answer to the question of the step S133 is negative (NO), the program proceeds to a step S136, wherein a T0 map for non-EGR condition, not shown, is retrieved to determine the basic delay time constant T0 for non-EGR region, followed by the program proceeding to the step S135.

At the step S135, a delay time constant correction coefficient KT is retrieved from a KT map according to the estimated port wall temperature TC' and the engine rotational speed NE to determine a delay time constant correction coefficient KT, and at the following step S137, the reciprocal of the delay time constant T is calculated by the use of Equation (29):

$$1/T=(1/T0)\times KT \quad (29)$$

The KT map is set as shown in FIG. 17 such that the correction coefficient KT assumes a value within the range of 0 to 1, and the higher the estimated port wall temperature TC', the larger value the correction coefficient KT assumes. When the estimated intake port wall temperature TC' is equal to or higher than 80 °C., the correction coefficient KT is set to 1.0.

At the following steps S138 to S141, limit checking of the value of 1/T is carried out. More specifically, if the value of 1/T exceeds a range defined by an upper limit value TLMTH and a lower limit value TLMTL, the value of 1/T is set to the upper limit value TLMTH at a step S140 or to the lower limit value TLMTL at a step S141, followed by terminating the program.

Figure 20:
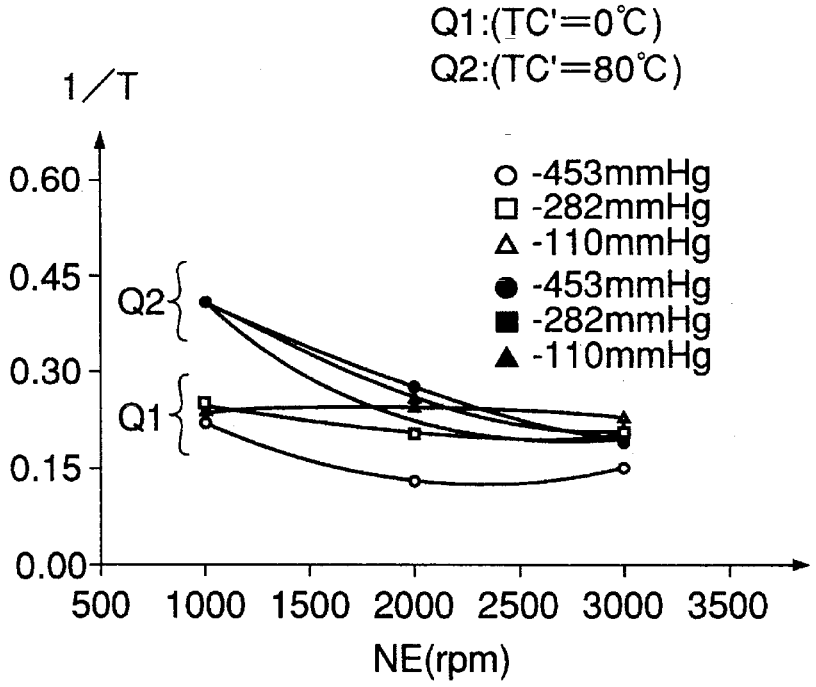
FIG. 20 is a diagram showing an example of values of 1/T assumed under various operating conditions of the engine.

The value of 1/T thus obtained shows a tendency as depicted in FIG. 20.

Figure 22:
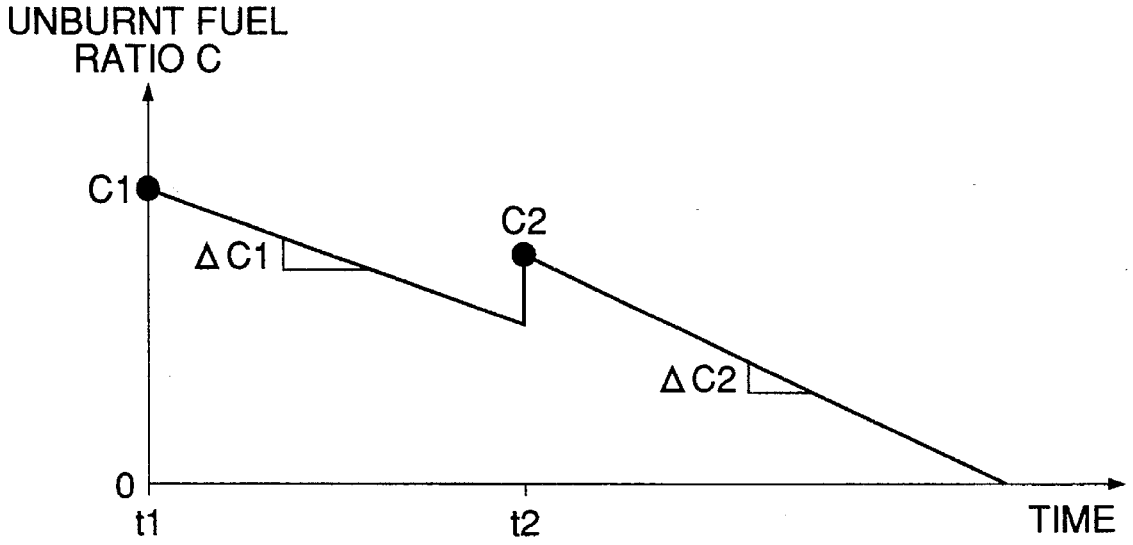
FIG. 22 is a timing chart which is useful in explaining the concept of a manner of calculation of the unburnt fuel ratio C.
Figure 21:
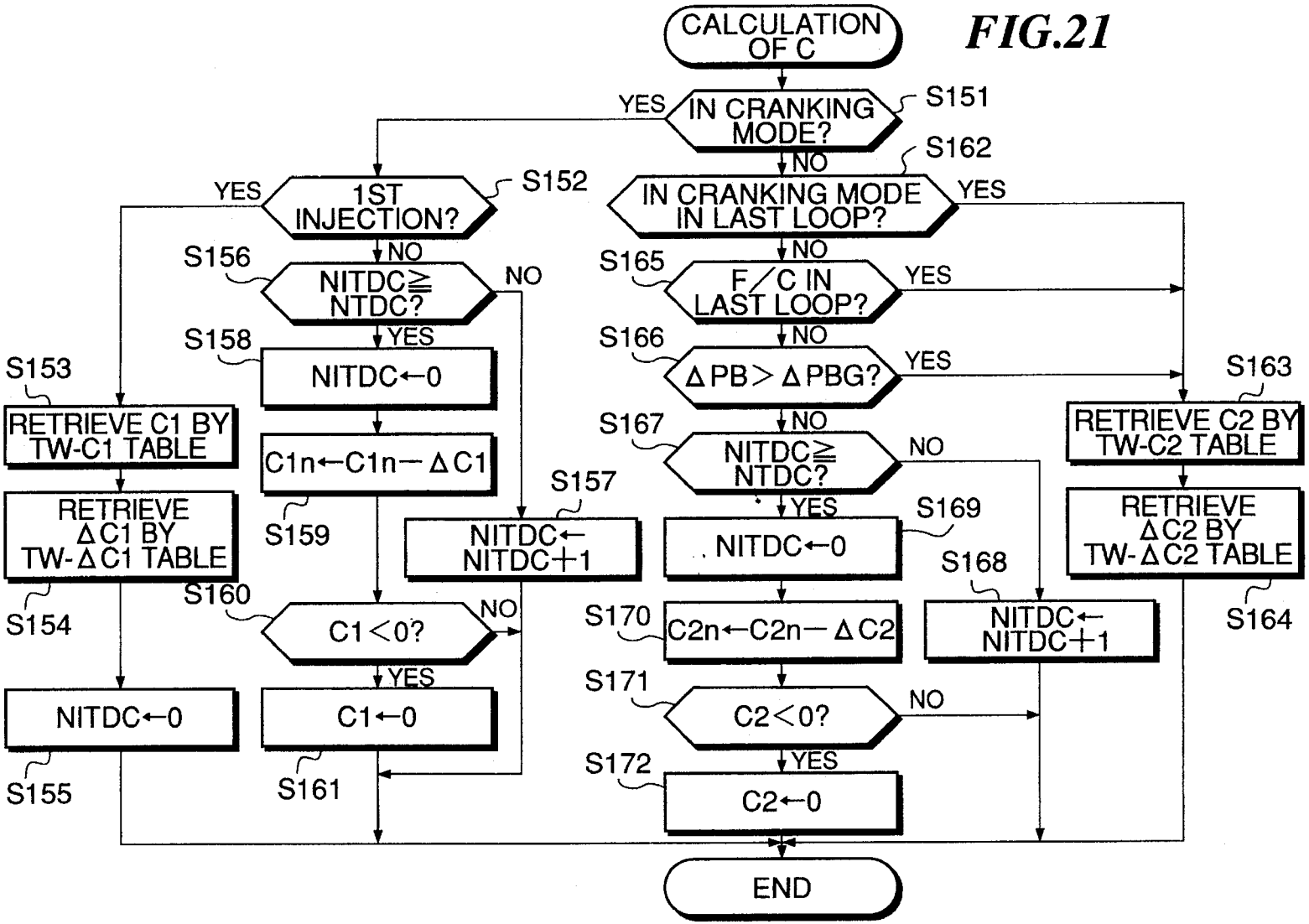
FIG. 21 is a flowchart showing an unburnt fuel ratio C-calculating routine.

FIG. 21 shows a routine for calculating the unburnt fuel ratio C described hereinabove, while FIG. 22 shows a timing chart which is useful in explaining the concept of calculation of the unburnt fuel ratio C.

First, at a step S151, it is determined whether or not the engine is in the cranking mode. If the answer to this question is affirmative (YES), the program proceeds to a step S152, wherein it is determined whether or not fuel has been initially or first injected at the start of the engine. If the answer to this question is affirmative (YES), the program proceeds to a step S153, wherein a TW-C1 table, not shown, is retrieved according to the engine coolant temperature TW to determine a cranking unburnt fuel ratio C1 as an initial value of the unburnt fuel ratio C at a time point tl appearing in FIG. 22. The TC-C1 table is set such that the higher the engine coolant temperature, the smaller value the starting unburnt fuel ratio C1 assumes.

Further, at the following step S154, an TW-ΔC1 table, not shown, is retrieved to determine a decremental value ΔC1 of the cranking unburnt fuel ratio C1. Then, at the following step S155, an NITDC counter for use in changing the unburnt fuel ratio C is set to a predetermined value of 0, followed by terminating the routine.

If the answer to the question of the step S152 is negative (NO) when a second or later fuel injection is carried out during the starting mode, the program proceeds to a step S156, wherein it is determined whether or not the count of the NITDC counter is equal to or higher than a predetermined value NTDC. The answer to this question in the first execution of this step is negative (NO), and hence the program proceeds to a step S157, wherein the count of the NITDC counter is incremented, followed by terminating the routine. When the count of the NITDC counter is equal to the predetermined value NTDC, the answer to the question of the step S156 becomes affirmative (YES), and then the program proceeds to a step S158.

At the step S158, the NITDC counter is set to the predetermined value of 0 again, and then at a step S159, the decremental value ΔC1 is subtracted from the starting fuel unburnt ratio C1. Then, it is determined at a step S160 whether or not the updated starting fuel unburnt ratio C1 is equal to or smaller than the predetermined value of 0. If the answer to this question is affirmative (YES), the starting unburnt fuel ratio C1 is set to 0, followed by terminating the program.

If the answer to the question of the step S151 is negative (NO), the program proceeds to a step S162, where it is determined whether or not the engine was in the cranking mode in the immediately preceding loop. The answer to this question is affirmative (YES) in the first execution of this step, the program proceeds to a step S163, wherein an after-cranking unburnt fuel ratio C2 as an initial value of the unburnt fuel ratio C is retrieved from a TW-C2 table, not shown, according to which the after-cranking unburnt fuel ratio C2 has a tendency similar to that of the TW-C1 table, at a time point t2 appearing in FIG. 22.

Further, at the following step S164, an after-cranking unburnt fuel decremental value ΔC2 is retrieved from a TW-ΔC2 table, not shown, according to which unburnt fuel decremental value ΔC2 has a tendency similar to that of the TW-ΔC2 table, followed by terminating the routine.

Then, in the following loop, the answer to the question of the step S162 becomes negative (NO), and then the program proceeds to a step S165, wherein it is determined whether or not fuel cut was carried out in the immediately preceding loop. If the answer to this question is affirmative (YES), it means that the engine has resumed fuel injection after fuel cut, so that the air-fuel ratio can drastically change. Therefore, it is judged that part of fuel injected immediately after resumption of fuel injection can remain unburnt, and the unburnt fuel ratio C is reset to the initial value thereof at the steps S163 and S164, followed by terminating the routine.

If the answer to the question of the step S165 is negative (NO), the program proceeds to a step S166, wherein it is determined whether or not the intake pipe negative pressure PB has changed by an amount of change ΔPB larger than a predetermined value a PBG. If the answer to this question is affirmative (YES) as well, the unburnt fuel ratio C is reset to the initial value thereof at the steps S163 and S164, followed by terminating the routine.

If the answer to the question of the step S166 is affirmative (YES), a processing similar to that carried out at the steps S156 to S161 is carried out with the cranking unburnt fuel ratio C1 being replaced by the cranking unburnt fuel ratio C2, and the cranking decremental value ΔC1 by the cranking decremental value ΔC2.

Description has been made as to how the direct supply ratio A, the delay time constant T, and the unburnt fuel ratio C, as parameters concerning the fuel transfer delay-dependent correction, are calculated. The f(KO2)-setting coefficient α referred to hereinabove is determined by retrieving a TW-α table which is set such that the higher the engine coolant temperature, the smaller value the f(KO2)-setting coefficient α assumes.

Next, description will be made as to how the fuel transfer delay-dependent correction of the fuel injection amount is carried out for an initial fuel injection at the start of the engine, during the cranking mode, and then during the normal mode after cranking, with reference to respective schematic representations of the fuel transfer delay-dependent correction.

Figure 23:
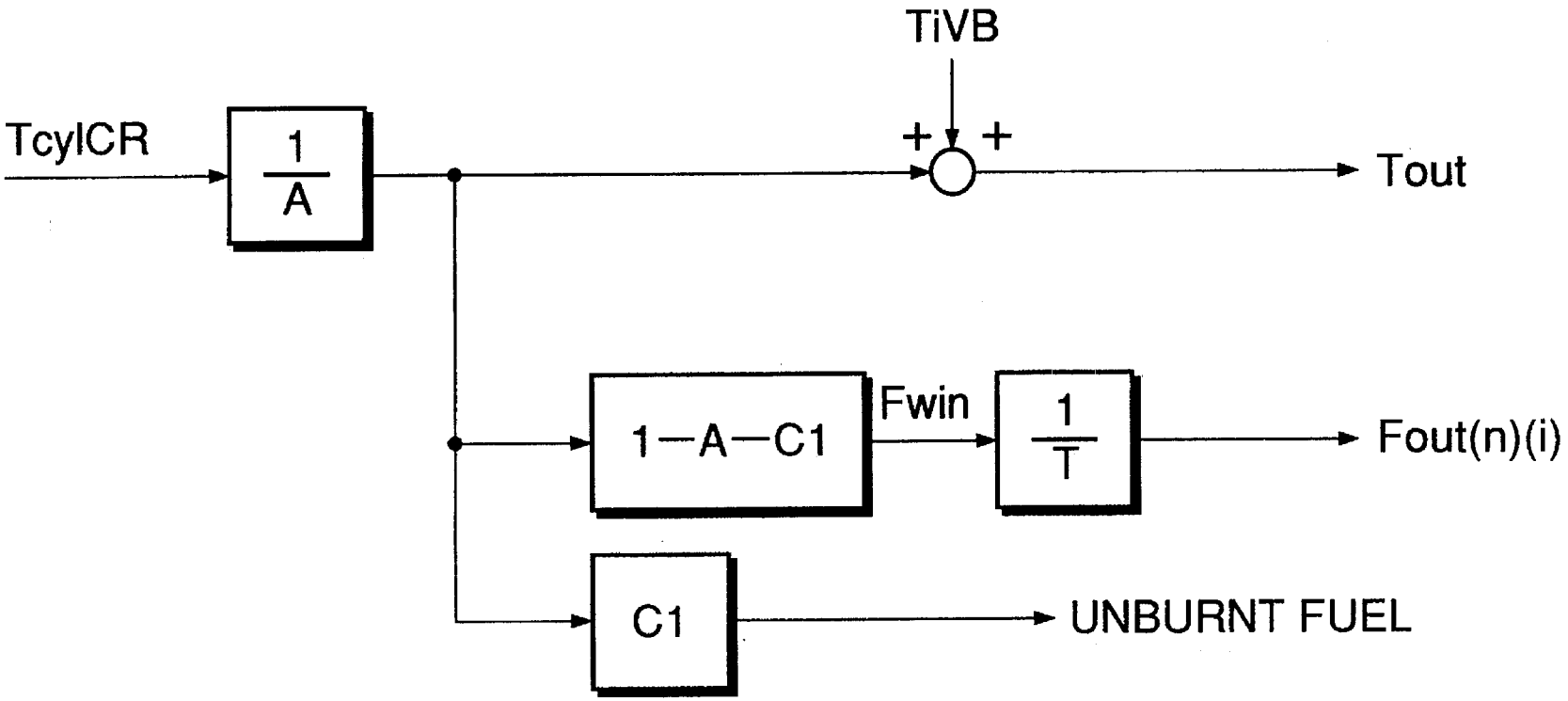
FIG. 23 is a schematic representation of a physical model circuit modeled on a manner of the fuel transfer delay-dependent correction of the fuel injection amount carried out when simultaneous injection of fuel is initially carried out at the start of the engine.

FIG. 23 schematically represents a physical model circuit modeled on the fuel transfer delay-dependent correction effected at a simultaneous injection (initial injection at the start of the engine) carried out in the cranking mode of the engine. The figure shows how the fuel injection amount Tout is calculated when the required fuel amount TcylCR at the start of the engine is determined.

In the figure, the required fuel amount TcylCR is calculated by the use of the above Equation (17). At this initial injection at the start of the engine, the carried-off fuel amount Fwout is set to 0, and then the fuel injection amount Tout is calculated during the CRK processing by the use of the above Equation (24). Therefore, the carried-off fuel amount Fwout(n)(i) appearing in the figure is actually used in the second and later injections during the cranking mode. Further, in the initial injection at the start of the engine, the unburnt fuel ratio C1 is retrieved from the TW-C1 table as described hereinabove with reference to FIG. 21, particularly to the step S153 appearing therein.

Figure 24:
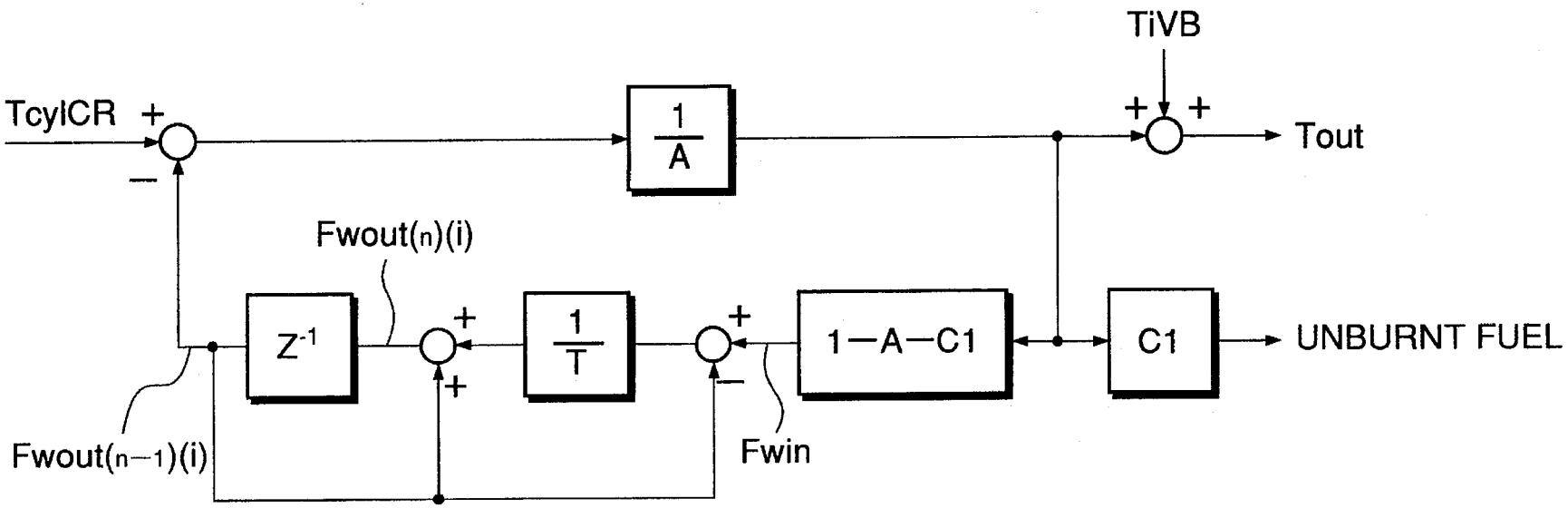
FIG. 24 is a schematic representation of a physical model circuit modeled on a manner of the fuel transfer delay-dependent correction of the fuel injection amount carried out when sequential injection has started following the simultaneous injection of fuel during cranking mode of the engine.

FIG. 24 schematically represents a physical model circuit modeled on the fuel transfer delay-dependent correction effected at a sequential injection after the simultaneous injection carried out in the cranking mode of the engine. The figure also shows how the fuel injection amount Tout is calculated when the required fuel amount TcylCR in the cranking mode is determined.

In the figure, the required fuel amount TcylCR is calculated by the use of the above Equation (17) during the TDC processing. Then, the fuel injection amount Tout and the carried-off fuel amount Fwout are calculated by the use of the above Equations (24) and (25) during the CRK processing. The updated value Fwout(n)(i) of the carried-off fuel amount is stored for use in determination of the injection stage thereafter.

Figure 25:
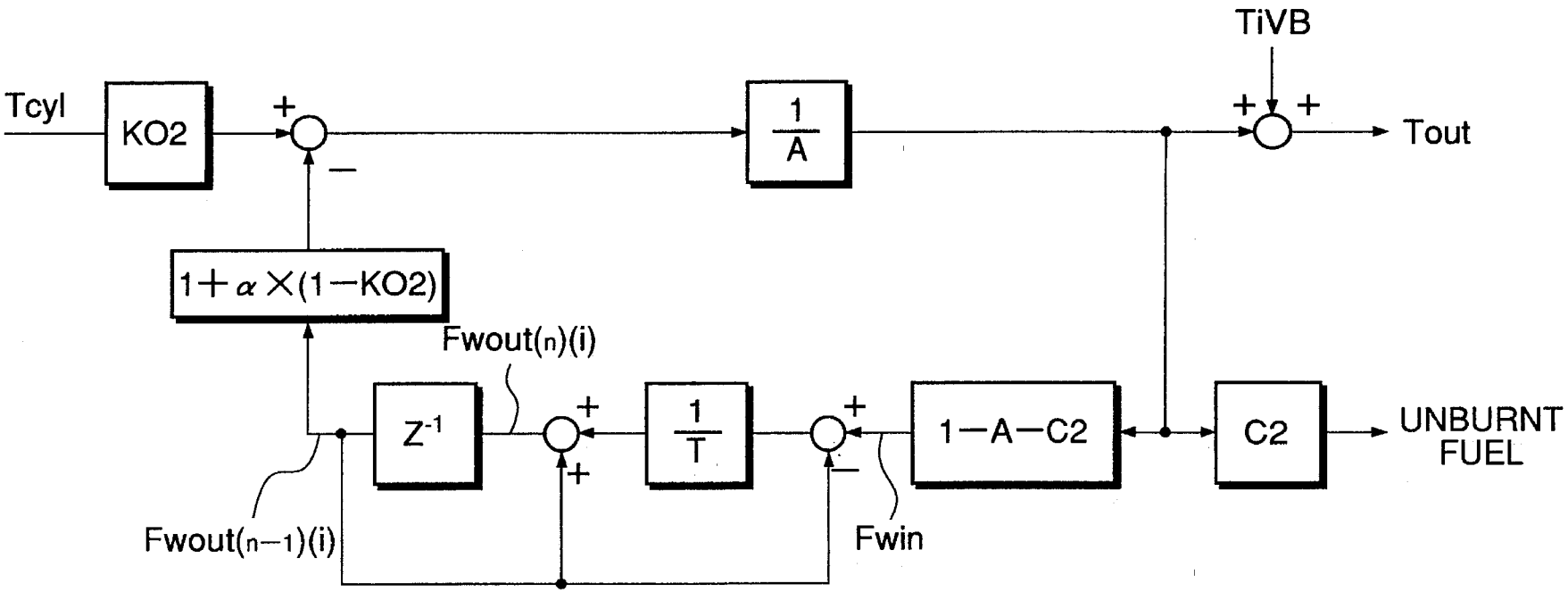
FIG. 25 is a schematic representation of a physical model circuit modeled on a manner of the fuel transfer delay-dependent correction of the fuel injection amount carried out when the engine is operating in a normal mode after the cranking mode.

FIG. 25 schematically represents a physical model circuit modeled on of the fuel transfer delay-dependent correction effected in the normal mode of the engine. The figure also shows how the fuel injection amount Tout is calculated when the required fuel amount TcylCR in the normal mode is determined.

The processing shown in this figure is distinguished from that carried out during the cranking mode shown in FIG. 24, in that the air-fuel ratio correction coefficient KO2 and the f(KO2)-setting coefficient $\alpha$ are used as additional parameters, and the unburnt fuel ratio C1 is replaced by the unburnt fuel ratio C2.

More specifically, as shown in this figure, the required fuel amount Tcyl is calculated by the use of the above Equation (20) during the TDC processing, and a fuel injection amount Tout corresponding to the required fuel amount Tcyl is calculated by the use of the above equation (27). Further, the carried-off fuel amount Fwout is calculated by the use of the above Equation (25), and the updated value Fwout(n)(i) of the carried-off fuel amount obtained in the present loop is stored for use in determination of the injection stage.

What is claimed is:

1. In a fuel injection amount control system for an internal combustion engine having an intake passage, said intake passage having a wall surface, at least one fuel injection valve, and at least one combustion chamber, including first fuel amount-calculating means for calculating a first amount of fuel directly drawn into said at least one combustion chamber out of an amount of fuel injected into said intake passage via said at least one fuel injection valve, second fuel amount calculating means for calculating a second amount of fuel carried off fuel adhering to said wall surface of said intake passage into said at least one combustion chamber, fuel injection amount-calculating means for calculating an amount of fuel to be injected into said intake passage, based on said first amount of fuel and said second amount of fuel, air-fuel ratio detecting means for detecting an air-fuel ratio of exhaust gases from said engine, air-fuel ratio correction amount-calculating means for calculating an air-fuel ratio correction amount, based on an output from said air-fuel ratio-detecting means, and air-fuel ratio correcting means for correcting said amount of fuel to be injected into said intake passage by said air-fuel ratio correction amount, the improvement comprising carried-off fuel amount-correcting means for correcting said second fuel amount, based on said air-fuel ratio correction amount; and driving means for driving said at least one fuel injection valve in order to supply said corrected amount of fuel to be injected to said intake passage, wherein said carried-off fuel amount-correcting means includes carried-off fuel amount correction coefficient-setting means for setting a carried-off fuel amount correction coefficient such that said carried-off fuel amount correction coefficient assumes a smaller value as said air-fuel ratio correction amount is larger, said carried-off fuel amount-correcting means correcting said second amount of fuel by said carried-off fuel amount correction coefficient.

2. A fuel injection amount control system according to claim 1, wherein said carried-off fuel amount correction coefficient is set such that said carried-off fuel amount correction coefficient is changed at a larger rate according to said air-fuel ratio correction amount, as a ratio of said first amount of fuel to said amount of fuel injected into said intake passage is smaller.

3. A fuel injection amount control system for an internal combustion engine having an intake passage, said intake passage having a wall surface, at least one fuel injection valve, at least one combustion chamber, and an exhaust passage, comprising:

first fuel amount-calculating means for calculating a first amount of fuel directly drawn into said at least one combustion chamber and burned therein out of an amount of fuel injected into said intake passage via said at least one fuel injection valve;

second fuel amount-calculating means for calculating a second amount of fuel directly drawn into said at least one combustion chamber and exhausted therefrom without being burned therein out of said amount of fuel injected into said intake passage via said at least one fuel injection valve;

third fuel amount-calculating means for calculating a third amount of fuel carried off fuel adhering to said wall surface of said intake passage into said at least one combustion chamber;

fuel injection amount-calculating means for calculating an amount of fuel to be injected into said intake passage, based on said first amount of fuel, said second amount of fuel and said third amount of fuel; and driving means for driving said at least one fuel injection valve in order to supply said calculated amount of fuel to be injected to said intake passage.

4. A fuel injection amount control system according to claim 3, wherein said second amount of fuel is calculated based on said amount of fuel injected into said intake passage and an unburnt fuel ratio determined based on operating conditions of said engine.

5. A fuel injection amount control system according to claim 4, wherein said operating conditions of said engine include a temperature of coolant circulating through said engine, said unburnt fuel ratio being set to a larger value as said engine coolant temperature is lower.

6. A fuel injection amount control system according to claim 4, wherein said unburnt fuel ratio is set to a large initial value immediately after said engine has started or resumed fuel injection.

7. A fuel injection amount control system for an internal combustion engine having an intake passage, said intake passage having a wall surface, at least one fuel injection valve, at least one combustion chamber, and an exhaust passage, comprising:

first fuel amount-calculating means for calculating a first amount of fuel directly drawn into said at least one combustion chamber out of an amount of fuel injected into said intake passage via said at least one fuel injection valve;

second fuel amount-calculating means for calculating a second amount of fuel carried off fuel adhering to said wall surface of said intake passage into said at least one combustion chamber and burned therein;

third fuel amount-calculating means for calculating a third amount of fuel carried off said fuel adhering to said wall surface of said intake passage into said at least one combustion chamber and exhausted therefrom without being burnt therein;

fuel injection amount-calculating means for calculating an amount of fuel to be injected into said intake passage, based on said first amount of fuel, said second amount of fuel and said third amount of fuel; and driving means for driving said at least one fuel injection valve in order to supply said calculated amount of fuel to be injected to said intake passage.

8. A fuel injection amount control system according to claim 7, wherein said third amount of fuel is calculated based on said amount of fuel injected into said intake passage and an unburnt fuel ratio determined based upon operating conditions of said engine.

9. A fuel injection amount control system according to claim 8, wherein said operating conditions of said engine include a temperature of coolant circulating through said engine, said unburnt fuel ratio being set to a larger value as said engine coolant temperature is lower.

10. A fuel injection amount control system according to claim 8, wherein said unburnt fuel ratio is set to a large initial value immediately after said engine has started or resumed fuel injection.

11. An intake passage wall surface temperature-estimating device for an internal combustion engine having an intake passage, said intake passage having a wall surface, comprising:

coolant temperature-detecting means for detecting a temperature of coolant circulating through said engine;

intake air temperature-detecting means for detecting a temperature of intake air in said intake passage of said engine; and intake passage wall surface temperature-estimating means for estimating a temperature of said wall surface of said intake passage, based on said coolant temperature detected by coolant temperature-detecting means and said temperature of said intake air in said intake passage detected by said intake air temperature-detecting means, at an intermediate temperature between said coolant temperature and said temperature of said intake air.

12. An intake passage wall surface temperature-estimating device according to claim 11, wherein said intake passage wall surface temperature-estimating means interiorly divides a difference between said coolant temperature and said temperature of said intake air, by a predetermined interior division ratio, thereby estimating said intake passage wall surface temperature.

13. An intake passage wall surface temperature-estimating device according to claim 11, wherein said intake passage wall surface temperature-estimating means estimates said intermediate temperature between said coolant temperature and said temperature of intake air in said intake passage as a temperature of said wall surface of said intake passage in a steady condition of said engine, and further subjects said temperature of said wall surface of said intake passage in said steady condition of said engine to delay processing, thereby estimating a temperature of said wall surface of said intake passage in a transient condition of said engine.

14. An intake passage wall surface temperature-estimating device according to claim 11, wherein said temperature of said intake air in said intake passage detected by said intake air temperature-detecting means is corrected by an amount of change in an output from said intake air temperature-detecting means.

15. An intake passage wall surface temperature-estimating device according to claim 12, wherein said engine includes an exhaust passage, and exhaust gas-recirculating means for recirculating exhaust gases from said exhaust passage to said intake passage, and wherein said intake passage wall surface temperature-estimating means sets said predetermined interior division ratio depending on a ratio of exhaust gas recirculation effected by said exhaust gas-recirculating means.

16. A fuel injection amount control system for an internal combustion engine having an intake passage, comprising:

fuel injection amount-determining means for calculating parameters indicative of fuel transfer characteristics in said intake passage, based on operating conditions of said engine, and for determining an amount of fuel to be injected into said intake passage, depending on said parameters calculated;

coolant temperature-detecting means for detecting a temperature of coolant circulating through said engine;

intake air temperature-detecting means for detecting a temperature of intake air in said intake passage of said engine;

intake passage wall surface temperature-estimating means for estimating a temperature of said wall surface of said intake passage, based on said coolant temperature detected by said coolant temperature-detecting means and said temperature of said intake air in said intake passage detected by said intake air temperature-detecting means, at an intermediate temperature between said coolant temperature and said temperature of said intake air;

parameter correcting means for correcting said parameters indicative of said fuel transfer characteristics in said intake passage, based on said temperature of said wall surface of said intake passage estimated by said intake passage wall surface temperature-estimating means; and injecting means for injecting said determined amount of fuel into said intake passage.

17. A fuel injection amount control system for an internal combustion engine, said internal combustion engine having an intake passage with a wall surface, at least one fuel injection valve, and at least one combustion chamber, said fuel injection amount control system comprising:

detection means for detecting an air-fuel ratio of exhaust gases from said engine;

control means coupled to said detection means, said control means being configured to perform the steps of calculating a first amount of fuel directly drawn into the at least one combustion chamber out of an amount of fuel injected into said intake passage via said at least one fuel injection valve;

calculating a second amount of fuel carried off fuel adhering to said wall surface of the intake passage into said at least one combustion chamber;

calculating an amount of fuel to be injected into said intake passage, based upon the first amount of fuel and the second amount of fuel;

detecting an air-fuel ratio of exhaust gases from said engine, based upon an output of the detecting means;

calculating an air-fuel ratio correction amount, based upon the detected air-fuel ratio;

correcting the amount of fuel to be injected into said intake passage by the air-fuel ratio correction amount;

correcting the second fuel amount based upon the air-fuel ratio correction amount; and driving said at least one fuel injection valve in order to supply said corrected amount of fuel to be injected to said intake passage, wherein said control means performs the further steps of setting a carried-off fuel amount correction coefficient such that the carried-off fuel amount correction coefficient is reduced as the air-fuel ratio correction amount is increased, said control means correcting the second amount of fuel based upon the carried-off fuel amount correction coefficient.

18. A fuel injection amount control system as recited in claim 17, wherein said control means sets the carried-off fuel amount correction coefficient such that the carried-off fuel amount correction coefficient is charged at a larger rate according to the air-fuel ratio correction amount, as a ratio of the first amount of fuel to the amount of fuel injected into said intake passage is smaller.

19. A fuel injection amount control system for an internal combustion engine having an intake passage with a wall surface, and at least one combustion chamber, said fuel injection amount control system comprising:

at least one fuel injection valve for injecting fuel into said internal combustion engine;

control means coupled to said at least one fuel injection valve, said control means being configured to perform the steps of calculating a first amount of fuel directly drawn into said at least one combustion chamber and burned therein out of an amount of fuel injected into said intake passage via at said least one fuel injection valve;

calculating a second amount of fuel directly drawn into said at least one combustion chamber and exhausted therefrom without being burned therein out of said amount of fuel injected into said intake passage via said at least one fuel injection valve;

calculating a third amount of fuel from fuel adhering to said wall surface of said intake passage and carried into said at least one combustion chamber;

calculating an amount of fuel to be injected into said intake passage by said at least one fuel injection valve based upon the first amount of fuel, the second amount of fuel, and the third amount of fuel; and driving said at least one fuel injection valve in order to supply the calculated amount of fuel to be injected into said intake passage.

20. A fuel injection amount control system as recited in claim 19, wherein said control means calculates the second amount of fuel based upon the amount of fuel injected into said intake passage and an unburned fuel ratio which is determined based upon data indicative of operating conditions of said engine.

21. A fuel injection amount control system as recited in claim 20, wherein the operating conditions of said engine include a temperature of coolant circulating therethrough, said control means being configured to increase the unburned fuel ratio as the engine coolant temperature decreases.

22. A fuel injection amount control system as recited in claim 20, wherein the unburned fuel ratio is set to an initial value immediately after said engine has started or resumed fuel injection, the initial value being larger than a normal operating value.

23. A fuel injection amount control system for an internal combustion engine having an intake passage with a wall surface, and at least one combustion chamber, said fuel injection amount control system comprising:

at least one fuel injection valve for injecting fuel into said internal combustion engine;

control means coupled to said at least one fuel injection valve, said control means being configured to perform the steps of calculating a first amount of fuel directly drawn into said at least one combustion chamber and burned therein out of an amount of fuel injected into said intake passage via said at least one fuel injection valve;

calculating a second amount of fuel from fuel adhering to said wall surface of said intake passage and carried into said at least one combustion chamber, and burned therein;

calculating a third amount of fuel from fuel adhering to said wall surface of said intake passage and carried into said at least one combustion chamber and being exhausted therefrom without being burned therein;

calculating an amount of fuel to be injected into said intake passage based on the first amount of fuel, the second amount of fuel, and the third amount of fuel; and driving said at least one fuel injection valve in order to supply the calculated amount of fuel to be injected into said intake passage.

24. A fuel injection amount control system as recited in claim 23, wherein said control means is configured to calculate the third amount of fuel based on the amount of fuel injected into said intake passage and an unburned fuel ratio determined based upon operating conditions of said engine.

25. A fuel injection amount control system as recited in claim 24, wherein the operating conditions of said engine include a temperature of coolant circulating through said engine, and wherein said control means is configured to increase the unburned fuel ratio as said engine coolant temperature decreases.

26. A fuel injection amount control system as recited in claim 24, wherein said control means is configured to set the unburned fuel ratio to an initial value immediately after said engine has started or resumed fuel injection, the initial value being larger than a normal operating value.

27. An intake passage wall surface temperature-estimating apparatus for an internal combustion engine, wherein said internal combustion engine includes an intake passage having a wall surface, said apparatus comprising:

coolant temperature-detecting means for detecting a temperature of coolant circulating through said engine;

intake air temperature-detecting means for detecting a temperature of intake air in said intake passage of said engine; and control means for estimating an intake passage wall surface temperature, said control means being configured to estimate a temperature of said wall surface of said intake passage based upon the coolant temperature detected by said coolant temperature-detecting means, and the temperature of the intake air in said intake passage detected by said intake air temperature-detecting means, at an intermediate temperature between the coolant temperature and the temperature of the intake air.

28. An intake passage wall surface temperature-estimating apparatus as recited in claim 27, wherein said control means is configured to estimate the intake passage wall surface temperature by interiorly dividing a difference between the coolant temperature and the temperature of the intake air by a predetermined interior division ratio.

29. An intake passage wall surface temperature-estimating apparatus as recited in claim 27, wherein said control means is configured to estimate the intermediate temperature between the coolant temperature and the temperature of intake air in said intake passage as a temperature of said wall surface of said intake passage in a steady condition of said engine, said control means being further configured to estimate a temperature of said wall surface of said intake passage of said engine in a transient condition of said engine by delay processing.

30. An intake passage wall surface temperature-estimating apparatus as recited in claim 27, wherein said control means is configured to correct the temperature of the intake air in said intake passage detected by said intake air temperature-detecting means by an amount of change in an output from said intake air temperature-detecting means.

31. An intake passage wall surface temperature-estimating apparatus as recited in claim 28, wherein said engine also includes an exhaust passage and exhaust gas-recirculating means for recirculating exhaust gases from said exhaust passage to said intake passage, and wherein said control means is configured to set the predetermined interior division ratio depending upon a ratio of exhaust gas recirculation effected by said exhaust gas-recirculating means.

32. A fuel injection amount control system for an internal combustion engine having an intake passage, said system comprising:

coolant temperature-detecting means for detecting a temperature of coolant circulating through said engine;

intake air temperature-detecting means for detecting a temperature of intake air in said intake passage of said engine;

control means for controlling fuel injection amounts to said engine, said control means being configured to calculate parameters indicative of fuel transfer characteristics in said intake passage, said parameters being calculated based upon operating conditions of said engine;

determine an amount of fuel to be injected into said intake passage depending upon the parameters calculated;

estimate a temperature of said wall surface of said intake passage based on the coolant temperature detected by said coolant temperature-detecting means and the temperature of the intake air in said intake passage detected by said intake air temperature-detecting means at an intermediate temperature between the coolant temperature and the temperature of the intake air;

correct the parameters indicative of the fuel transfer characteristics in said intake passage based upon the estimated temperature of the wall surface of the intake passage; said apparatus further comprising injecting means for injecting the determined amount of fuel into said intake passage.

* * * * *